US006280534B1

(12) United States Patent
Senda et al.

(10) Patent No.: US 6,280,534 B1
(45) Date of Patent: Aug. 28, 2001

(54) GRAIN ORIENTED ELECTROMAGNETIC STEEL SHEET AND MANUFACTURING THEREOF

(75) Inventors: Kunihiro Senda; Toshito Takamiya; Makoto Watanabe; Mitsumasa Kurosawa, all of Okayama (JP)

(73) Assignee: Kawasaki Steel Corporation (JP)

( * ) Notice: Subject to any disclaimer, the term of this patent is extended or adjusted under 35 U.S.C. 154(b) by 0 days.

(21) Appl. No.: 09/309,240

(22) Filed: May 10, 1999

(30) Foreign Application Priority Data

May 15, 1998 (JP) ..... 10-133386
May 15, 1998 (JP) ..... 10-133387

(51) Int. Cl.[7] ..... H01F 1/047
(52) U.S. Cl. ..... 148/113; 148/111
(58) Field of Search ..... 148/110–113

(56) References Cited

U.S. PATENT DOCUMENTS 3,908,432 * 9/1975 Ichiyama et al. ..... 148/111
4,268,326 * 5/1981 Iwayama et al. ..... 148/113
4,576,658 * 3/1986 Inokuti et al. ..... 148/111
4,875,947 * 10/1989 Nakayama et al. ..... 148/113
5,725,681 * 3/1998 Ishitobi et al. ..... 148/113

FOREIGN PATENT DOCUMENTS 60-92423 * 5/1985 (JP) .
5-171284 * 7/1993 (JP) .

* cited by examiner

*Primary Examiner*—John Sheehan
(74) *Attorney, Agent, or Firm*—Schnader Harrison Segal & Lewis LLP

(57) ABSTRACT

Method of making a grain oriented electromagnetic steel sheet having excellent magnetic properties, by a series of steps ranging from hot rolling to final finishing annealing for a silicon steel slab containing from about 0.001 to 0.07 wt % bismuth, wherein the average cooling rate for about five seconds measured immediately after the end of hot rolling is controlled within a range of from about 30 to 120° C./second; the value of the ratio $P_{H2O}/P_{H2}$ of the atmosphere for the soaking step in decarburization annealing is adjusted within a range of from about 0.45 to 0.70; and a treatment is provided for inhibiting decomposition of the surface inhibitor during final finishing annealing.

8 Claims, 12 Drawing Sheets

GRAIN ORIENTED ELECTROMAGNETIC STEEL SHEET AND MANUFACTURING THEREOF

BACKGROUND OF THE INVENTION

1. Field of the Invention

The present invention relates to a grain oriented electromagnetic steel sheet adapted to be used for an iron core of a transformer or other electrical appliances.

2. Description of the Related Art

A grain oriented electromagnetic steel sheet as an iron core material for a transformer, a generator or a motor is required to have a high magnetic flux density and a low-iron loss as the most important properties.

Various measures have so far been taken to achieve a low iron loss of the grain oriented electromagnetic steel sheet. Among others, importance has been attached to high integration of the grain orientations of the steel sheet in the {110} <001> orientation known also as Goss orientation. When grain orientations of the steel sheet are highly integrated in Goss orientation, <001> axes which are axes of easy magnetization of iron crystal would highly be integrated in the rolling direction. That is, force required for magnetization in the rolling direction becomes smaller, resulting in a smaller coercive force. As a result, hysteresis loss becomes smaller, thus permitting achievement of a low iron loss.

Aligning grain orientations in Goss orientation greatly contributes to reduction of noise upon magnetization which is an important required property of a grain oriented electromagnetic material. Magnetostriction vibration and electromagnetic vibration of the iron core material are known to be causes of noise produced from a transformer. An improved degree of integration of grain orientations in Goss orientation inhibits generation of 90° magnetic domain forming a cause of magnetostriction. Simultaneously with this, decreased excited current inhibits electromagnetic vibration, thus resulting in reduction of noise.

For a grain oriented electromagnetic steel sheet, as described above, integration of <001> axes of crystal grains in the rolling direction is the most important subject. As an indicator of the degree of integration, the magnetic flux density, $B_8$ (T) at a magnetization force of 800 A/m is often employed. That is, development efforts of a grain oriented electromagnetic steel sheet are promoted with improvement of magnetic flux density $B_8$ as an important target. The iron loss is typically represented by an energy loss, $W_{17/50}$ (W/kg) under conditions including an excited magnetic flux density of 1.7 T and an excited frequency of 50 Hz.

The secondary recrystallization grains of the grain oriented electromagnetic steel sheet are formed through a phenomenon known as secondary recrystallization during the final finishing annealing. Enormous growth of crystal grains in Goss orientation is selectively caused by secondary recrystallization to increase the degree of integration in Goss orientation, thus obtaining a product having a desired magnetic property. In order to effectively accelerate integration of secondary recrystallization grains in Goss orientation, it is important to form a precipitation dispersion called an inhibitor which inhibits normal growth of primary recrystallization grains, uniformly throughout the steel and in an appropriate size. Presence of the inhibitor makes it possible to inhibit normal grain growth of primary recrystallization grains, and maintain a fine state of primary recrystallization grains even at high temperatures during final finishing annealing. At the same time, there is provided a higher selectivity for the growth of crystal grains in a preferred orientation, thus resulting in a higher degree of integration of crystal grains in Goss orientation and permitting achievement of a high magnetic flux density. In general, it is believed that a higher degree of integration in Goss orientation is available when the inhibitor is stronger and the normal growth inhibiting ability is great.

A material having a small solubility in steel such as MnS, MnSe, $Cu_{2-x}S$, $Cu_{2-x}Se$ or AlN is applicable as an inhibitor. For example, Japanese Patent Publication No. 33-4710 and Japanese Patent Publication No. 40-15644 disclose adding aluminum to a material, using a high reduction within a range of from 81 to 95% for the final cold rolling, and applying annealing before the final cold rolling, thereby causing precipitation of AlN, a strong inhibitor.

Further, it is known that, in addition to the inhibitor constituents mentioned above, addition of Sn, As, Bi, Sb, B, Pb, Mo, Te, V, or Ge is effective for improvement of the degree of orientation integration of secondary recrystallization grains.

From among these additional inhibitor constituents, P, As, Sb and Bi falling under the category of 5B family elements in the Periodic Table are known to intensify the normal grain growth inhibiting ability and improve magnetic property is cooperation with the main inhibitor such as MnS, MnSe, $Cu_{2-x}S$, $Cu_{2-x}Se$ or AlN through segregation on grain boundaries. Among others, bismuth is considered helpful as a component intensifying the normal grain growth inhibiting ability through a grain boundary segregation effect because of a particularly low solubility in iron.

A technique to improve magnetic property by adding bismuth is disclosed in Japanese Examined Patent Publication No. 51-29496 and Japanese Patent Examined Publication No. 54-32412. Japanese Patent Publication No. 62-56924, Japanese Unexamined Patent Publication No. 2-813673 and Japanese Examined Patent Publication No. 7-62176 disclose methods of compositely adding AlN, MnSe or MnS together with bismuth into steel. These techniques, while utilizing the inhibiting power intensifying effect by bismuth, have not as yet been established manufacturing conditions appropriate for a material added with bismuth, and are therefore insufficient to obtain stably a grain oriented electromagnetic steel sheet having satisfactory magnetic property.

Japanese Unexamined Patent Publications Nos. 6-88171, 6-88172, 6-88173 and 6-88174 disclose the possibility of largely improving magnetic flux density by adding bismuth to an aluminum-based inhibitor. The effect itself of addition of bismuth has however been known, but the magnetic property improving effect has not as yet been stably derived.

A method of stabilizing magnetic property of an electromagnetic steel sheet containing added bismuth is disclosed in Japanese Unexamined Patent Publication No. 6-158169. This publication, while mainly disclosing a technique of heating a steel slab having a low sulfur or selenium content to a low temperature and performing nitriding during heating, discloses also a manufacturing method comprising the steps of adding bismuth to steel and carrying out the latter half of decarburization annealing in a reducing atmosphere. However, the decarburization annealing conditions in this techniques mainly aims at stabilizing formation of a film. That is, optimum conditions for stabilizing the magnetic property improving effect for a material added with bismuth have not as yet been established.

Regarding a separator for final finishing annealing, Japanese Unexamined Patent Publication No. 8-253819 discloses a technique of forming a film having an amount of coating of at least 5 g/m$^2$ per side of the steel sheet. This technique has an object to improve the film through improvement of gas ventilation between coil layers, not providing a function of stabilizing magnetic property. Further, according to the result of research conducted by the present inventors, a simple increase in the amount of coated separator would result in a reverse effect for the stabilization of the magnetic property.

As to the technique of using a low-activity material as an annealing separator for the silicon steel with added bismuth, Japanese Unexamined Patent Publication No. 6-256849 discloses a method of coating a material low in reactivity with $SiO_2$ after application of a nitriding treatment. However, the function of bismuth in this technique is only to prevent decomposition of the inhibitor during a final finishing annealing unique to a mirror-finishing material including a nitriding step. Japanese Unexamined Patent Publication No. 7-173544 discloses a manufacturing method of a mirror-finished grain oriented electromagnetic steel sheet by coating an annealing separator added with a metal chloride onto a silicon steel with added bismuth. This technique has as well a main object to obtain a mirror surface by the addition of bismuth into the steel, and consequently, a satisfactory magnetic property cannot stably be obtained unless decarburization annealing conditions are controlled.

Japanese Unexamined Patent Publication No. 9-202924 discloses a method of coating alumina as an annealing separator after carrying out decarburization annealing in an atmosphere not generating iron oxides, or removing oxides from the surface of the decarburization-annealed sheet. In this technique, alumina is used as an annealing separator for the purpose of obtaining a satisfactory magnetic property without being affected by the gas ventilation between coil layers during final finishing annealing. Application of this technique permits achievement of reduction of the amount of oxygen on the surface of the final-finishing-annealed sheet under the effect of the alumina separator, and stabilizes the magnetic property to some extent. However, since the decarburization annealing conditions are favorable only for mirror surface finishing, secondary recrystallization grains cannot be completely stabilized. When using alumina as an annealing separator, it becomes difficult to remove impurities from the steel, and brings about a problem of deterioration of hysteresis loss.

In other words, addition of bismuth, being very helpful for the improvement of the magnetic property of a grain oriented electromagnetic steel sheet, tends to cause defective secondary recrystallization under the effect of various factors, and leaves a difficulty in stably obtaining a satisfactory magnetic property.

The present invention has, as an object, to stabilize secondary recrystallization of a grain oriented electromagnetic steel sheet with added bismuth, and permit manufacture of a grain oriented electromagnetic steel sheet having excellent magnetic flux density and iron loss.

SUMMARY OF THE INVENTION

As a result of extensive studies, the present inventors reached the conclusion that, in order to stably obtain a satisfactory magnetic property from a silicon steel with added bismuth, it was important to create particular manufacturing conditions for the upstream processes such as hot rolling, as well as to optimize decarburization annealing conditions (particularly the atmosphere), and the final finishing annealing conditions. It was found also that, in formation of excessive forsterite film during final finishing annealing, a silicon steel containing added bismuth tended to cause odeterioration of the magnetic property. As a result of further studies carried out to solve this problem, we discovered the possibility of stably obtaining a grain oriented electromagnetic steel sheet having a high magnetic flux density by limiting formation of the forsterite film during finishing annealing using the silicon steel having added bismuth.

More specifically, the present invention provides a manufacturing method of a grain oriented electromagnetic steel sheet having excellent magnetic properties, comprising the steps of: heating a silicon steel slab containing from about 0.03 to 0.10 wt % carbon, from about 2.0 to 5.0 wt % silicon, from about 0.04 to 0.15 wt % manganese, from about 0.01 to 0.03 wt % one or more selected from sulfur and selenium, from about 0.015 to 0.035 wt % soluble aluminum and from about 0.0050 to 0.0100 wt % nitrogen to a temperature of at least about 1,300° C., hot-rolling the heated steel slab, then achieving a final thickness sheet through a combination of annealing and cold rolling, decarburization-annealing the annealed and cold-rolled steel sheet, and conducting a final finishing annealing; wherein the slab contains from about 0.001 to 0.070 wt % bismuth; the average cooling rate is controlled to about 30 to 120° C./sec for a period of five seconds from immediately after the completion of hot rolling; the ratio $P_{H2O}/P_{H2}$ in the atmosphere in the soaking step of the decarburization annealing procedure is adjusted to a value within a range of from about 0.45 to 0.70, and treatment for inhibiting decomposition of the surface layer inhibitor is incorporated in the final finishing annealing. Another feature of the invention is that the amount of oxygen on the surface of the finally finishing-annealing sheet, which is an indicator of the effect of inhibiting decomposition of the surface layer inhibitor during final finishing annealing, is controlled.

Still another aspect of the invention provides a method of manufacturing a grain oriented electromagnetic steel sheet having excellent magnetic properties, wherein the amount of MgO hydration of the annealing separator for the final finishing annealing, the amount of coating separator on the sheet surface, the amounts of added $TiO_2$ in the separator, and values of the ratio $P_{H2O}/P_{H2}$ in the heating and the soaking steps of decarburization annealing are optimized for inhibiting decomposition of the surface layer inhibitor during final finishing annealing. Improvement of the film and magnetic property is accomplished by optimizing the soaking temperature in the decarburization annealing procedure and adding an inhibitor-intensifying element such as Sn, Ni, Cr or Ge.

The invention provides also a grain oriented electromagnetic steel sheet having excellent magnetic properties, comprising a base metal portion of the final product containing up to about 0.0040 wt % carbon, from about 2.0 to 5.0 wt % silicon, from about 0.02 to 0.15 wt % manganese, up to about 0.0025 wt % of one or two elements selected from sulfur and selenium, up to about 0.0015 wt % aluminum, up to about 25 wtppm nitrogen, from about 0.0002 to 0.0600 wt % bismuth, and the balance substantially iron, wherein the average value of the shift angle θ between the [001] axis of crystal grains and the rolling direction, measured 200 mm or more from both ends of the product coil, equal to or less than about 5.0°.

DESCRIPTION OF THE PREFERRED EMBODIMENTS

Figure 1:
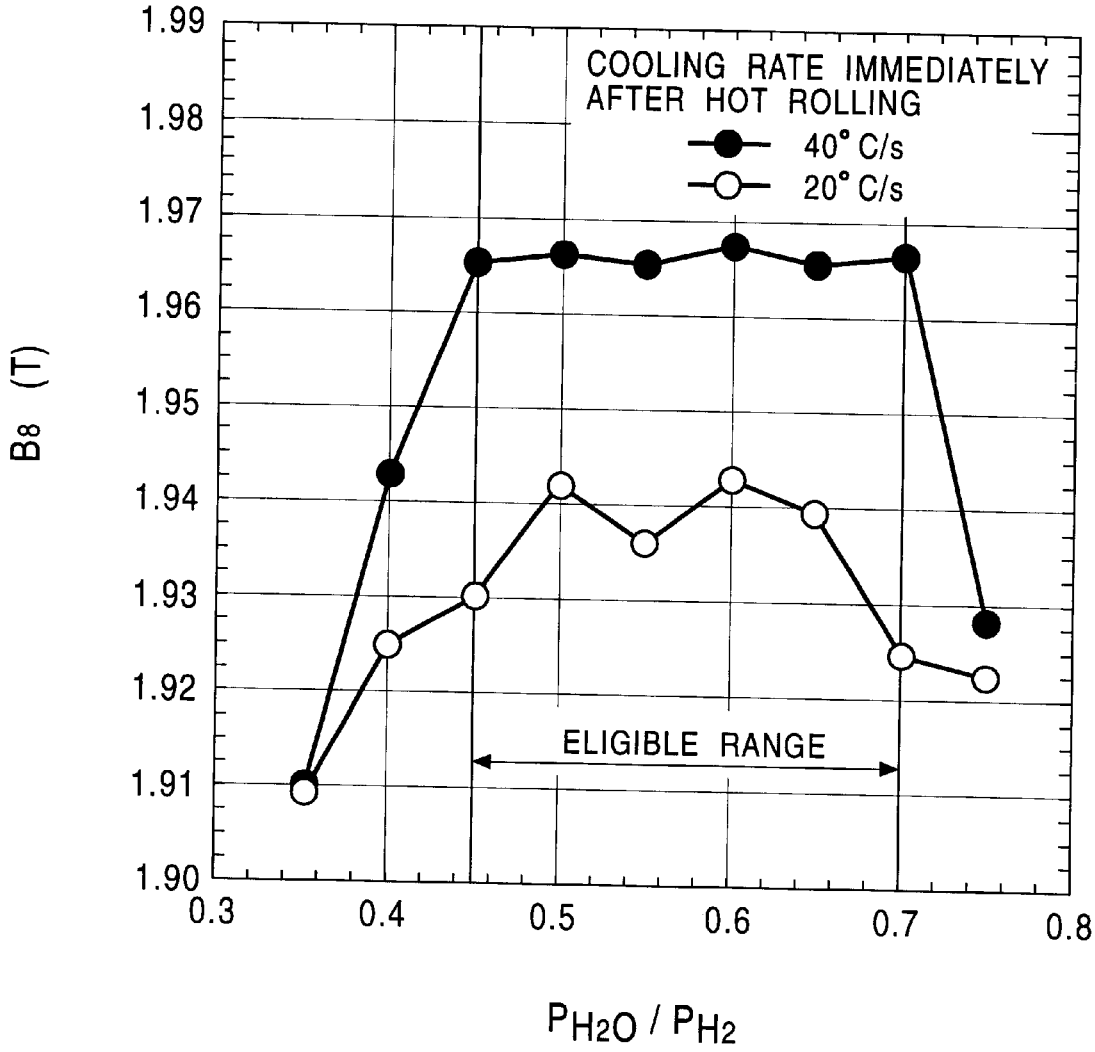
FIG. 1 is a graph that illustrates the effects, on the magnetic flux density $B_8$, of the ratio $P_{H2O}/P_{H2}$ in the atmosphere during decarburization annealing, and the cooling rate immediately after hot rolling.

The development of the present invention will now be preliminarily described sequentially along with several illustrative experiments.

EXPERIMENTS (Experiment 1)

A steel ingot mainly containing 0.06 wt % carbon, 3.2 wt % silicon, 0.07 wt % manganese, 0.02 wt % selenium, 0.005 wt % sulfur, 0.022 wt % aluminum, 0.0085 wt % nitrogen and 0.035 wt % bismuth was heated to 1,400° C., held for 30 minutes and then hot rolled into a hot-rolled steel sheet having a thickness of 2.5 mm. The average cooling rate of the hot-rolled steel sheet during five seconds immediately after hot rolling was 20° C./sec or 40° C./sec. Then, the hot-rolled steel sheet was subjected to a hot-rolled sheet annealing at 1,000° C. for 30 seconds, a pickling and then a primary cold rolling into a steel sheet having a thickness of 1.6 mm. Then, an intermediate annealing was applied to the cold-rolled steel sheet, and after pickling, the sheet was brought into a final thickness of 0.23 mm through a secondary cold rolling. Then, the resultant cold-rolled steel sheet was subjected to a decarburization annealing at a soaking temperature of 850° C. for 100 seconds. The ratio of the water vapor partial pressure to the hydrogen partial pressure in the atmosphere of the soaking step of decarburization annealing (oxidation potential): $P_{H2O}/P_{H2}$ was altered to various levels within a range of from 0.30 to 0.80. The same value as in the soaking step was set for $P_{H2O}/P_{H2}$ of the heating step of decarburization annealing. After coating an annealing separator mainly comprising MgO onto the decarburization-annealed sheet, a final finishing annealing was applied at a maximum temperature of 1,200° C. for five hours. Eight Epstein test pieces (30 mm wide and 280 mm long) were sampled in the rolling direction from the final finishing-annealed steel sheet and magnetic flux density $B_8$ was measured on these test pieces by the Epstein test method.

FIG. 1 illustrates the effects of $P_{H2O}/P_{H2}$ in the heating step and the soaking step of decarburization annealing on magnetic flux density $B_8$. As in clear from FIG. 1 that a high magnetic flux density $B_8$ of at least 1.965 T was obtained by using a higher cooling rate immediately after the end of hot rolling and controlling $P_{H2O}/P_{H2}$ of the decarburization annealing atmosphere within a range of from 0.45 to 0.7. Even with a value of $P_{H2O}/P_{H2}$ within the range of from 0.45 to 0.7, on the other hand, a low cooling rate immediately after the end of hot rolling resulted in a low and unstable magnetic flux density $B_8$, with a product containing 0.0122 wt % bismuth. For the portion of the product coil having a high magnetic flux density $B_8$ excluding the both width ends for 200 mm each, crystal grains had an average value θ of the shift angle between the [001] axis of each grain and the rolling direction within a range of 2.5 to 4.5°. The average value θ of the shift angle of grain orientation is defined as follows, and the measuring method was as described below.

1) The crystal grain orientation was measured at a pitch of 10 mm in the longitudinal direction and at a pitch of 10 mm in the width direction by the use of X-ray diffraction or the like for a portion of the entire width except for 200 mm on the both sides of the coil and about 100 mm in the longitudinal direction of the coil.

2) The Angle (absolute value) between the grain [001] axis and the rolling direction was determined for each portion to be measured.

3) Values of the grain orientation shift angle thus determined for the individual portions were averaged as θ.

(Experiment 2)

Figure 2:
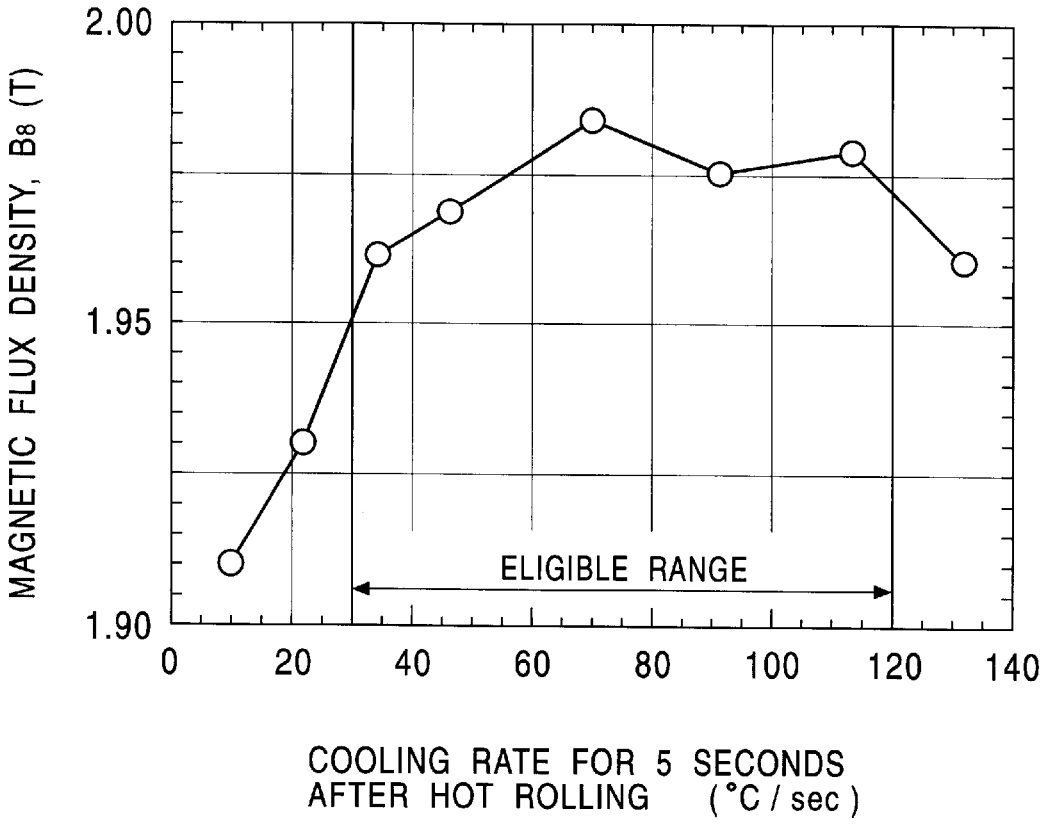
FIG. 2 is a graph that illustrates the effect on the magnetic flux density $B_8$ of the cooling rate achieved during the five seconds occurring immediately after hot rolling.

The relationship between the cooling rate immediately after the end of hot rolling and the magnetic property of the product was investigated. The experiment was carried out under the same conditions as in Experiment 1 except that the cooling rate immediately after the end of hot rolling was altered within a range of from 10 to 130° C./second, with a $P_{H2O}/P_{H2}$ of 0.40 for the heating step and a $P_{H2O}/P_{H2}$ of 0.60 for the soaking step of decarburization annealing. FIG. 2 illustrates the effect of the cooling rate during those five seconds measured immediately after the end of hot rolling on magnetic flux density $B_8$. FIG. 2 indicates that a high and stable magnetic flux density was available by controlling the cooling rate immediately after the end of hot rolling, within a range of from 30 to 120° C./second. With a cooling rate immediately after hot rolling of over 120° C./second, the hot-rolled steel sheet suffered from a seriously defective shape. The product contained bismuth within a range of 0.0140 wt %. The average value θ of shift angles between the [001] grain axis and the rolling direction of grains in the portion of the product coil (excluding 200 mm from both width ends) was within a range of from 2.4 to 3.5°.

(Experiment 3)

Figure 3:
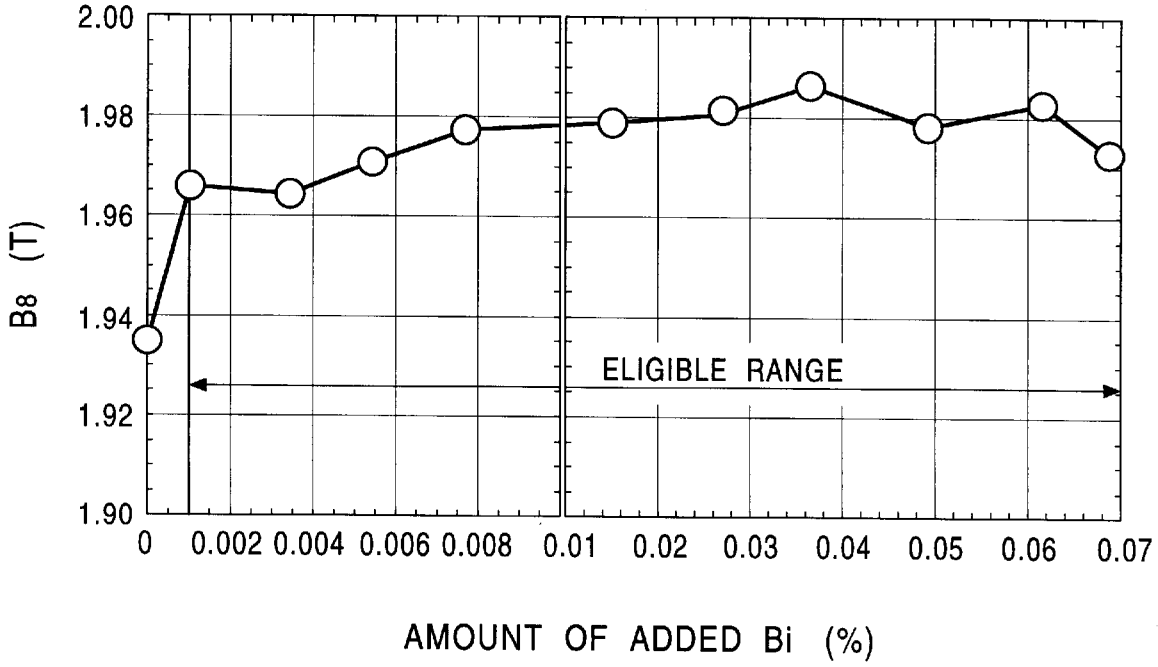
FIG. 3 is a graph that illustrates the effect of the amount of added bismuth on the magnetic flux density $B_8$.

The relationship between the amount of added bismuth and the magnetic property of the product was investigated. The experiment was carried out under the same conditions as in Experiment 1 except that the amount of added bismuth was varied within a range of from 0 to 0.068 wt %, with a $P_{H2O}/P_{H2}$ ratio of 0.35 for the heating step and a $P_{H2O}/P_{H2}$ ratio of 0.55 for the soaking step of decarburization annealing. FIG. 3 illustrates the effect of the amount of added bismuth on magnetic flux density $B_8$. It is revealed from FIG. 3 that the improvement of magnetic flux density was remarkable when the amount of added bismuth was from 0.001 to 0.07 wt %. The product contained from 0.0002 to 0.0505 wt % bismuth. The average value θ of the shift angle between the [001] grain axis and the rolling direction of the grains (in the portion of the product coil excluding 200 mm from both width ends) was within a range of from 1.5 to 3.9°.

(Experiment 4)

Steel ingots mainly comprising 0.06 wt % carbon, 3.2 wt % silicon, 0.07 wt % manganese, 0.02 wt % selenium, 0.005 wt % sulfur, 0.022 wt % aluminum and 0.0085 wt % nitrogen and containing 0 wt % or 0.035 wt % bismuth, respectively, were heated to 1,400° C., held for 30 minutes, and then hot-rolled into hot rolled sheets having a thickness of 2.4 mm. The average cooling rate of the hot-rolled sheets, during the five seconds immediately following the end of hot rolling, was 70° C./sec. Then, hot-rolled sheet annealing was applied to the resultant hot-rolled steel sheets at 1,000° C. for 30 seconds, and after pickling, the sheets were subjected to primary cold rolling into cold-rolled steel sheets having a thickness of 1.8 mm. Then, an intermediate annealing was applied to the cold-rolled steel sheets at 1,1000° C. for one minute, and after pickling, the sheets were rolled to a final thickness of 0.23 mm through secondary cold rolling. Then, the cold-rolled steel sheets were decarburization-annealed under conditions including a soaking temperature of 850° C., a soaking period of 100 seconds and a $P_{H2O}/P_{H2}$ of 0.60.

Subsequently, after coating an annealing separator mainly comprising MgO in a slurry form in various amounts of coating, finishing annealing was applied at a maximum temperature of 1,2000° C. for five hours. For the annealing separator, the amount of MgO hydration was altered within a range of from 0.5 to 5.0 wt %, and $TiO_2$ was added in an amount of 10 weight parts relative to 100 weight parts of MgO (excluding the weight of hydration water). The amount of coating was altered within a range of from 2 to 12 g/m$^2$ per single side of the steel sheet. The amount of MgO hydration was determined by causing hydration by mixing in suspension MgO in pure water at 20° C. for an hour, measuring the weight after drying at 300° C. for a minute (W1) and the weight after drying at 1,000° C. for 60 minutes (W2), and performing calculation with use of the following formula:

$$\text{Amount of hydration}=(W1-W2)/W1\times 100(\%)$$

Eight Epstein test pieces (30 mm width and 280 mm length) were sampled in parallel with the rolling direction from the final finishing-annealed steel sheet to measure magnetic flux density $B_8$ by the Epstein test method.

The amount of oxygen σ (g/m$^2$) per single side of the surface of the final finishing-annealed steel sheet was also measured. The value of σ was determined by subtracting the amount of oxygen derived from a chemical analysis of the substrate alone after removal of a surface film from the amount of oxygen derived from a chemical analysis of the final finishing-annealed sheet with the surface film adhering thereto, and connecting the resultant value into an amount of deposited oxygen per single side of the steel sheet.

Figure 4:
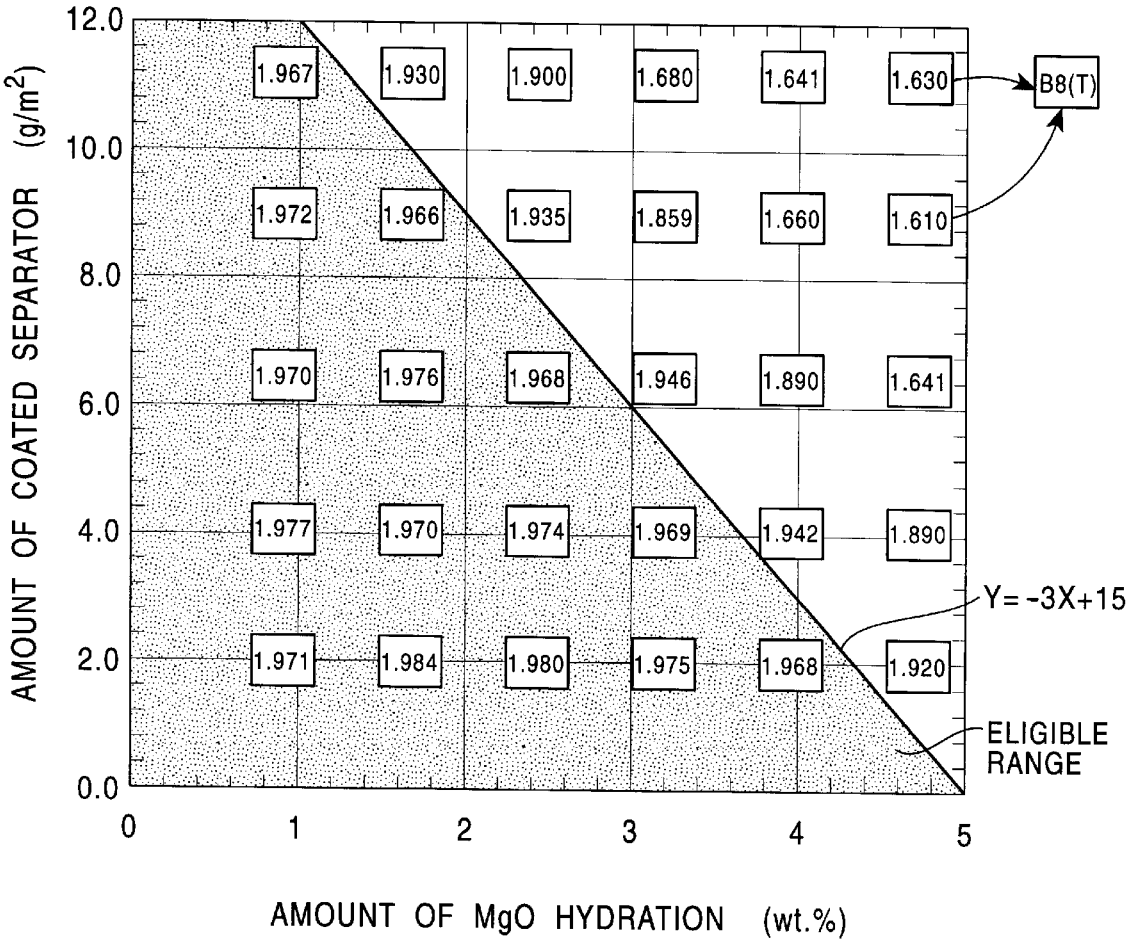
FIG. 4 is a graph that illustrates the effect on magnetic flux density $B_8$ of the amount of MgO hydration and the amount of coated separator.

FIG. 4 illustrates the effects of the amount of MgO hydration and the amount of coated separator on magnetic flux density $B_8$. FIG. 4 indicates that a magnetic flux density $B_8$ of at least 1.96 T is achievable by appropriately controlling the amount of coated annealing separator and the amount of MgO hydration. The hatched portion in FIG. 4 represents a range of stable availability of magnetic flux density $B_8$. On the assumption that X represents the amount of MgO hydration (wt %) and Y represents the amount of coated separator per single side of the steel sheet after coating and drying (g/m$^2$), the upper limit was expressed by the following formula (1):

$$Y \leqq -3X+15 \ldots \quad (1)$$

Figure 5:
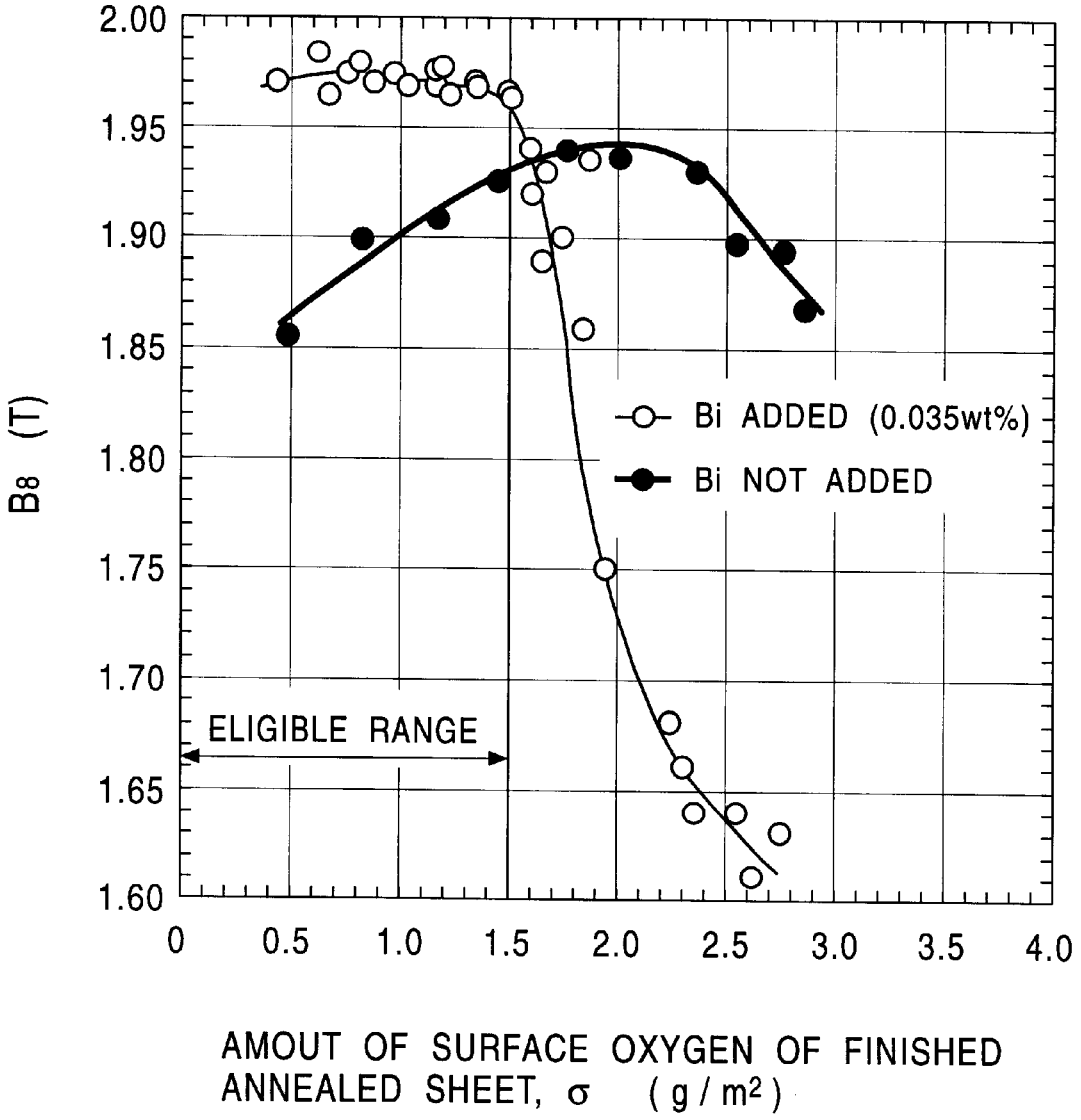
FIG. 5 is a graph that illustrates the effect on magnetic flux density $B_8$ of the amount of oxygen on the surface of the final finishing-annealed steel sheet, and also shows the effect of addition of bismuth on the value $B_8$.

FIG. 5 illustrates the effects of the amount of oxygen on the surface of the final finishing-annealed steel sheet and the addition of bismuth on magnetic flux density $B_8$. FIG. 5 reveals that magnetic flux density $B_8$ is regulated by σ in a steel ingot containing added bismuth, wherein controlling σ to equal to or less than 1.5 g/m$^2$ is important for obtaining stably a high magnetic flux density $B_8$. In a steel ingot without added bismuth, on the other hand, magnetic flux density $B_8$ was high within a range of σ from 1.5 to 2.5 g/m$^2$, and deterioration of $B_8$ magnetivity outside this range was slow.

Therefore, in order to stably obtain a satisfactory magnetic property in a steel containing added bismuth, it is important to control the amount of coated annealing separator and the amount of MgO hydration within the ranges shown in FIG. 4, or to limit the amount of oxygen σ on the surface of the final finishing-annealed steel sheet to up to 1.5 g/m$^2$, as indicated in FIG. 5.

(Experiment 5)

Figure 6:
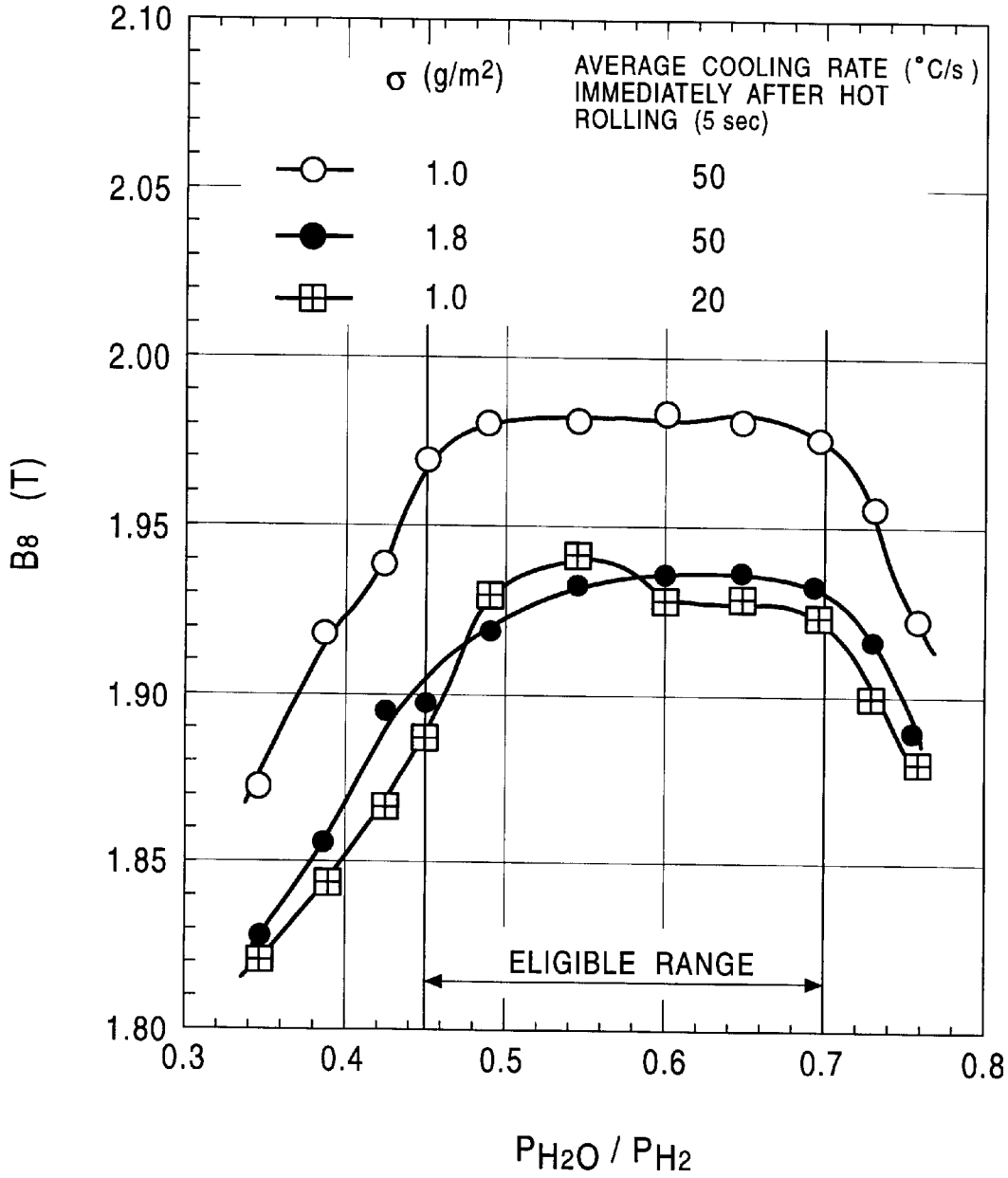
FIG. 6 is a graph that illustrates the effect of the ratio $P_{H2O}/P_{H2}$ in the soaking step of decarburization annealing, the amount by oxygen on the surface of the finishing-annealed sheet, and the cooling rate immediately after hot rolling, all on the magnetic flux density $B_8$.

The effects of the ratio $P_{H2O}/P_{H2}$ in decarburization annealing, the average cooling rate of the hot-rolled steel sheet during the five seconds measured immediately after the end of hot rolling, and the amount of oxygen a on the surface of the final finishing-annealed steel sheet on the magnetic property were investigated. The experiment was carried out under the same conditions as in Experiment 4 except that bismuth was added in an amount of 0.035 wt %; the value of $P_{H2O}/P_{H2}$ in decarburization annealing was varied; the average cooling rate of the hot-rolled steel sheet during five seconds immediately after the end of hot rolling was controlled at two levels of 20° C./sec and 50° C./sec; $TiO_2$ was added in an amount of 10 weight parts relative to 100 weight parts of MgO in the separator; and the amount of oxygen a on the surface of the final finishing-annealed steel sheet was adjusted to two levels of 1.0 g/m$^2$ or 1.8 g/m$^2$. FIG. 6 illustrates the effects of the ratio $P_{H2O}/P_{H2}$ in the soaking step of decarburization annealing, the amount of oxygen on the surface of the finishing-annealed steel sheet, and the cooling rate immediately after hot rolling on magnetic flux density $B_8$. According to FIG. 6, with σ=1.0 g/m$^2$ and an average cooling rate immediately after hot rolling of 50° C./second, a very high magnetic flux density $B_8$ was stably achieved within a range of $P_{H2O}/P_{H2}$ of from 0.45 to 0.70. With σ=1.8 g/m$^2$ or an average cooling rate immediately after hot rolling of 20° C./second, in contrast, a sufficient property was unavailable even within a range of $P_{H2O}/P_{H2}$ of from 0.45 to 0.70. It is therefore possible to stably obtain a product having a high magnetic flux density by controlling the average cooling rate immediately after hot rolling, the atmosphere for decarburization annealing, and the amount of oxygen on the surface of the final finishing-annealed steel sheet satisfying prescribed conditions.

(Experiment 6)

Figure 7:
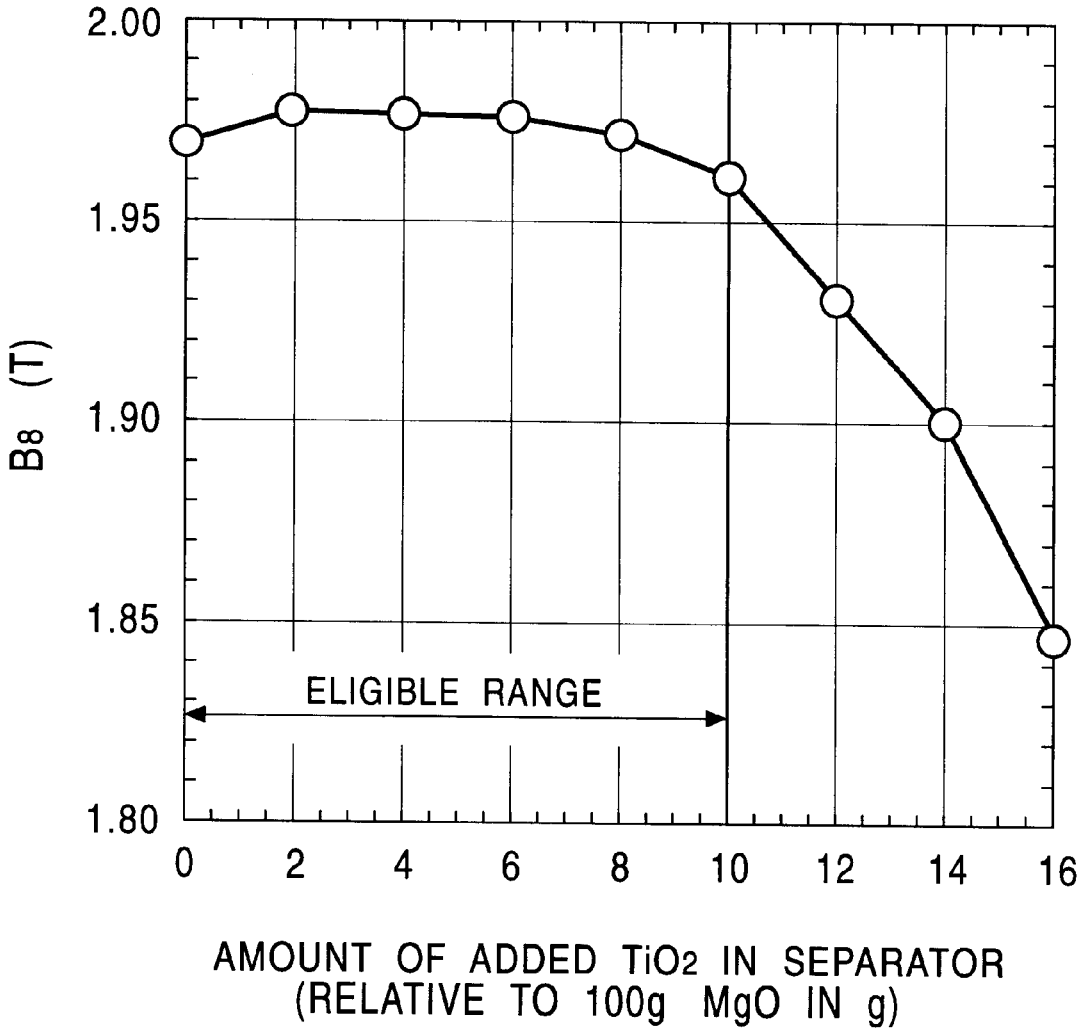
FIG. 7 is a graph that illustrates the effect of the amount of added $TiO_2$ in the annealing separator on the magnetic flux density $B_8$.

An experiment was carried out to study constituents of the annealing separator. The experiment was conducted under the same conditions as in Experiment 4 except that bismuth was added in an amount of 0.035 wt %, with an amount of coated annealing separator of 6.5 g/m$^2$ per single side, and an amount of hydration of 2.5 wt %. FIG. 7 illustrates the effect of the amount of added $TiO_2$ in the annealing separator on magnetic flux density $B_8$. As is clear from FIG. 7, a high magnetic flux density $B_8$ is stably achieved by limiting the amount of added $TiO_2$ to be added to the annealing separator to up to 10 weight parts relative to 100 weight parts of MgO. The increase in $TiO_2$ causes an increase in oxygen source in the annealing separator, while limitation of the amount of added $TiO_2$ causes a decrease in $\sigma$, thus permitting improvement of the degree of integration of secondary recrystallization grain orientations.

(Experiment 7)

Figure 8:
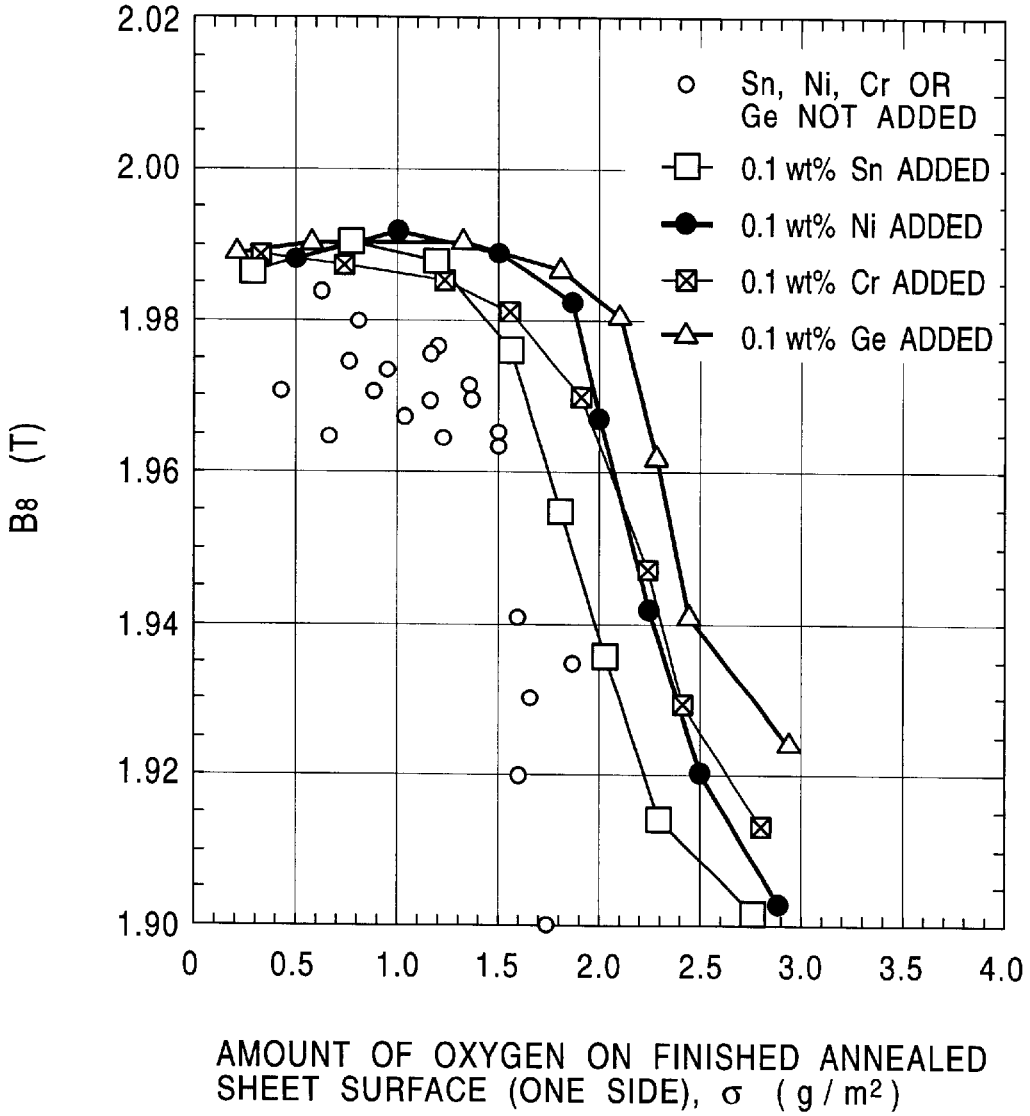
FIG. 8 is a graph that illustrates the effect of the amount of oxygen in the final finishing-annealed sheet on the magnetic flux density $B_8$ when adding Sn, Ni, Cr or Ge into the steel.

Trace additive elements effective for stably obtaining an excellent magnetic property were studied. The experiment was carried out under the same conditions as in Experiment 4 except that 0.1 wt % tin, 0.1 wt % nickel, 0.1 wt % chromium and 0.1 wt % germanium were individually added to a steel ingot containing 0.06 wt % carbon, 3.3 wt % silicon, 0.07 wt % manganese, 0.02 wt % selenium, 0.03 wt % soluble aluminum, 0.0090 wt % nitrogen and 0.030 wt % bismuth. FIG. 8 illustrates the relationship between $\sigma$ and magnetic flux density $B_8$ when adding tin, nickel, chromium and germanium. FIG. 8 reveals stable creation of a product having a higher magnetic flux density by adding tin, nickel, chromium and germanium in addition to the basic constituents. According to FIG. 8, as in FIG. 5, an increase in $\sigma$ causes a rapid deterioration of magnetic flux density $B_8$. When tin, nickel, chromium and germanium are added as constituents of steel, a satisfactory magnetic property was typically represented by a magnetic flux density $B_8$ of over 1.95 T even when $\sigma$ was over 1.5 g/m$^2$. With $\sigma \leqq 1.5$ g/m$^2$, there is created an excellent magnetic property of magnetic flux density $B_8 \geqq 1.97$ T.

Achieving a higher magnetic flux density stably obtained by the addition of tin, nickel, chromium and germanium is considered to be due to the fact that these elements display an inhibitor effect in a solid-solution state in steel and have a function of intensifying the effect of inhibiting grain growth of bismuth concentrated on grain boundaries. Another probability is that concentration on the steel sheet surface layer inhibits dissipation of bismuth from the surface. Under these effects, a higher magnetic flux density can be achieved in a bismuth-containing material, and a satisfactory magnetic property can be reached even when $\sigma$ is over 1.5 g/m$^2$.

(Experiment 8)

The effect of the atmospheres for the soaking step and the heating step of decarburization annealing was investigated. An experiment was carried out under the same conditions as in Experiment 1 except that the steel sheet was cooled at a cooling rate of 60° C./sec during a period (five seconds) immediately after the end of hot rolling; the value of $P_{H2O}/P_{H2}$ in the soaking step of decarburization annealing was altered within a range of from 0.35 to 0.80; the atmosphere for the heating step of decarburization annealing was controlled separately from the soaking step; and the value of $P_{H2O}/P_{H2}$ was varied within a range of from 0.20 to 0.75. The heating step of decarburization annealing was measured in an in-furnace area corresponding to a range of sheet temperature of from 255 to 765° C., and an average $P_{H2O}/P_{H2}$ value in this area was used as the value of $P_{H2O}/P_{H2}$ for the heating step.

Figure 9:
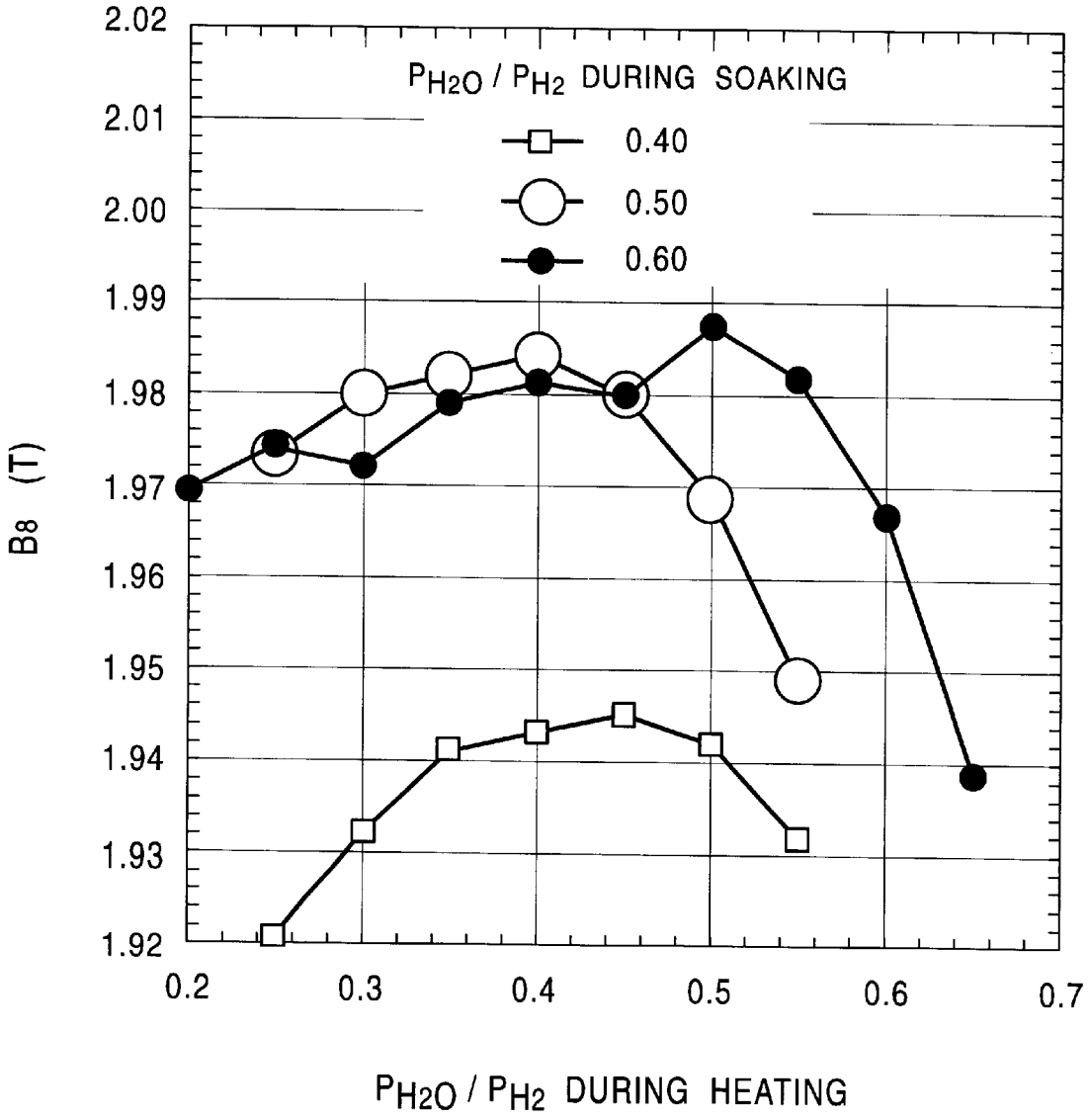
FIG. 9 is a graph that illustrates the effect of the atmospheric ratio $P_{H2O}/P_{H2}$ in the heating step and the soaking step of decarburization annealing on magnetic flux density $B_8$.

FIG. 9 illustrates the relationship between $P_{H2O}/P_{H2}$ and magnetic flux density $B_8$ for the heating step for cases with a $P_{H2O}/P_{H2}$ of 0.40, 0.50 and 0.60 for the soaking step. As in Experiment 1, a high magnetic flux density is obtained in cases with a $P_{H2O}/P_{H2}$ for the soaking step of 0.5 and 0.6. The value of $B_8$ was further improved by using a lower $P_{H2O}/P_{H2}$ in the heating step than in the soaking step.

Figure 10:
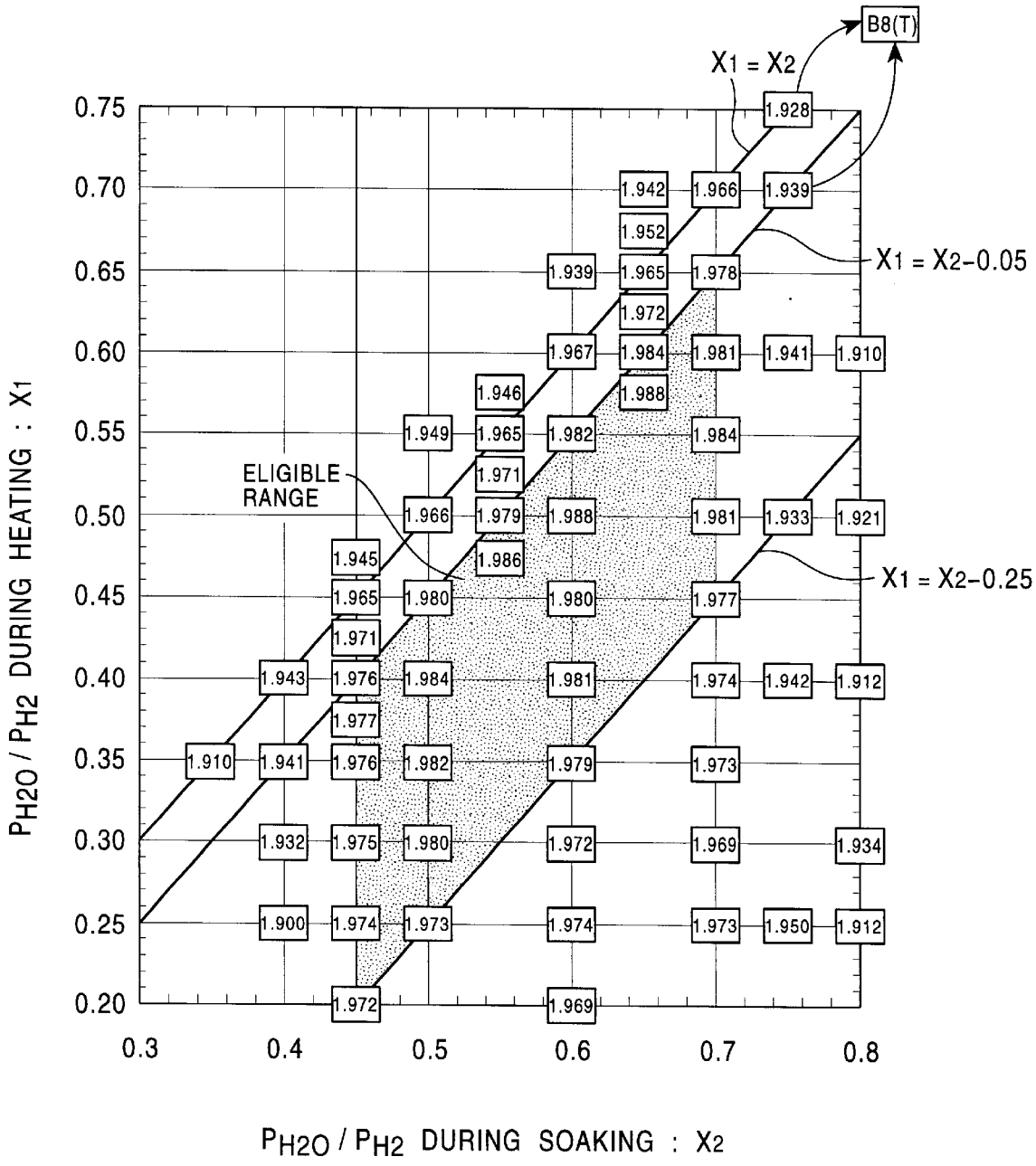
FIG. 10 is a graph that illustrates the effect of the atmospheric ratio $P_{H2O}/P_{H2}$ in the heating step and the soaking step of decarburization annealing on magnetic flux density $B_8$.

FIG. 10 illustrates the effects of $P_{H2O}/P_{H2}$ in the heating and soaking steps on magnetic flux density $B_8$ after finishing annealing. FIG. 10 reveals that a satisfactory magnetic flux density $B_8$ is available by using a value of $P_{H2O}/P_{H2}$ for the heating step of decarburization annealing lower by 0.05 to 0.25 than that for the soaking step. The hatched portion in FIG. 10 represents a range within which a very high magnetic flux density of a magnetic flux density $B_8$ of over 1.97 T is available, and is expressed by the following formula (2) on the definition of X1 representing the ratio $P_{H2O}/P_{H2}$ in the atmosphere in the heating step and X2 representing the ratio $P_{H2O}/P_{H2}$ in the atmosphere in the soaking step:

$$X2-0.25 \leqq X1 \leqq X2-0.05 \quad (2)$$

It is clear from this experiment that a more excellent magnetic flux density can be created by controlling the value of the ratio $P_{H2O}/P_{H2}$ for the heating step of decarburization annealing within a certain range lower than $P_{H2O}/P_{H2}$ for the soaking step.

(Experiment 9)

Figure 11:
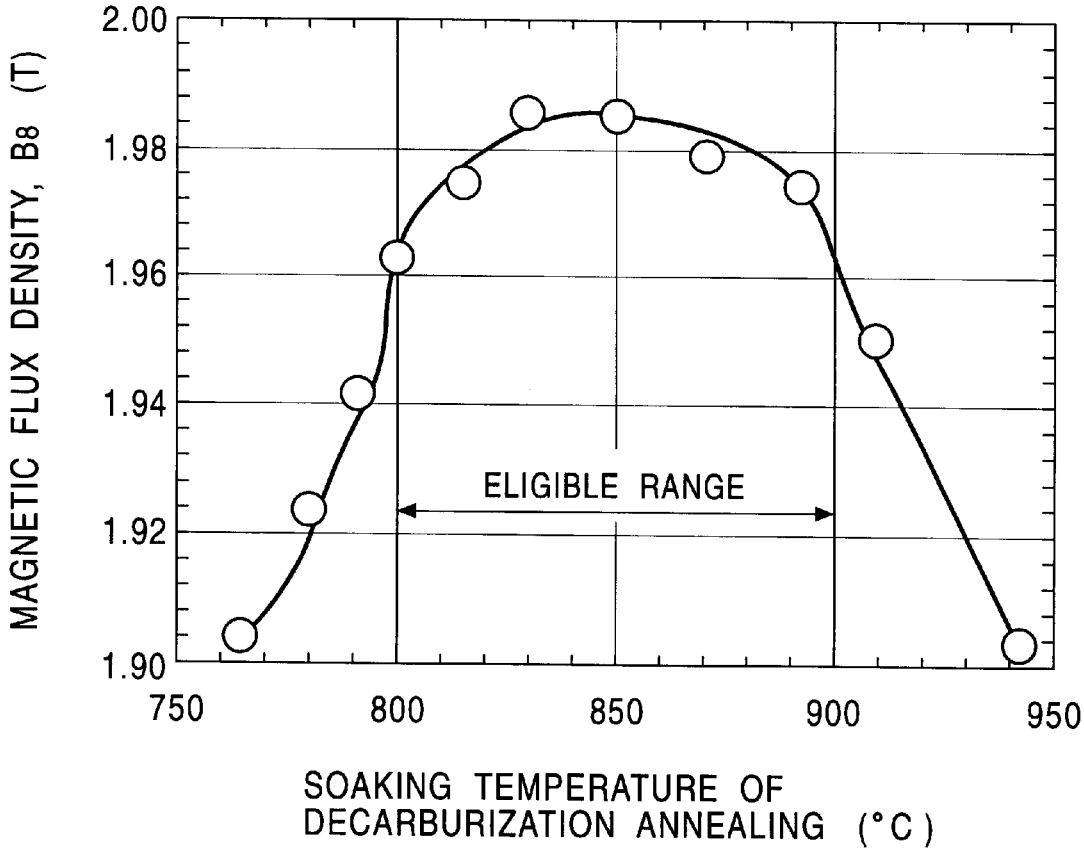
FIG. 11 is a graph that illustrates the effect of the soaking temperature of decarburization annealing on the magnetic flux density $B_8$.

The relationship between the soaking temperature of decarburization annealing and the magnetic property of the product was investigated. An experiment was carried out under the same conditions as in Experiment 1 except that the soaking temperature of decarburization annealing was varied within a range of from 750 to 950° C., and cooling was performed at an average cooling rate of 60° C./sec immediately after the end of hot rolling (five seconds), with a $P_{H2O}/P_{H2}$ of 0.40 for the heating step and a $P_{H2O}/P_{H2}$ of 0.60 for the soaking step of decarburization annealing. The result is shown in FIG. 11. A high and stable magnetic flux density was obtained by controlling the soaking temperature of decarburization annealing within a range of from 800 to 900° C.

(Experiment 10)

The effects of temperature and atmosphere in the latter half of the soaking step of decarburization annealing were investigated. An experiment was carried out under the same conditions as in Experiment 1 except that, with a cooling rate immediately after hot rolling of 60° C./sec, a soaking temperature of decarburization annealing of 850° C., a $P_{H2O}/P_{H2}$ for the soaking step of 0.60 or 0.30, and a $P_{H2O}/P_{H2}$ for the latter half (corresponding to 20 seconds of soaking step immediately before temperature decrease) of 0.05 or the same value as for the soaking step, the latter half temperature was varied within a range of from 770 to 970°

Figure 12:
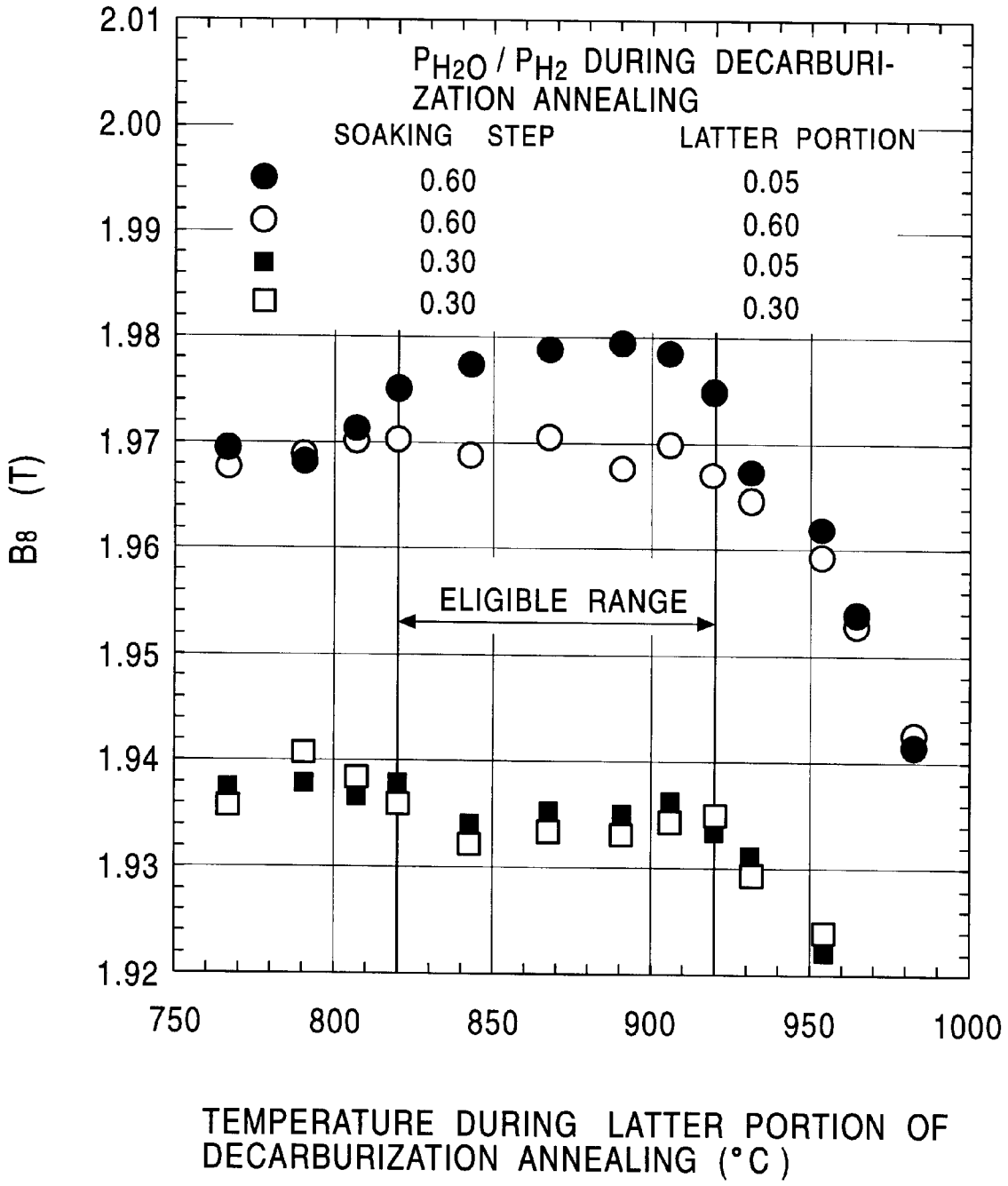
FIG. 12 is a graph that illustrates the effect of the temperature in the latter half of the soaking step of the decarburization annealing procedure, the atmospheric ratio $P_{H2O}/P_{H2}$ in the soaking step of decarburization annealing, and the ratio $P_{H2O}/P_{H2}$ in the latter half of the soaking step of decarburization annealing.

C. FIG. 12 illustrates the relationship between the latter half temperature of the soaking step of decarburization annealing and the value of $B_8$. Improvement of magnetic flux density $B_8$ was achieved by controlling the latter half temperature of the soaking step of decarburization annealing within a range of from 820 to 920° C. and the value of $P_{H2O}/P_{H2}$ of 0.05, as compared with the case with no change in the latter half of the soaking step of decarburization annealing. With a $P_{H2O}/P_{H2}$ for the soaking step of decarburization annealing of about 0.30, however, the magnetic flux density $B_8$ is at a low level irrespective of a change in the latter half of the soaking step of decarburization annealing. More specifically, an improvement of magnetic flux density can be achieved with control of the heating step atmosphere on the low oxidizing side, by using a $P_{H2O}/P_{H2}$ ratio for the soaking step of decarburization annealing within a range of from 0.45 to 0.70 and providing a reducing atmosphere zone in the latter half of the soaking step of decarburization annealing.

It was concluded from the results as described above that a very excellent magnetic property could be achieved by controlling, in a bismuth-added steel, 1) the cooling rate immediately after the end of hot rolling, 2) atmosphere and temperature of decarburization annealing, and 3) the amount-of coated annealing separator, the amount of MgO hydration and the amount of added $TiO_2$.

The reasons of limiting the chemical compositions of the materials within the aforementioned ranges in the present invention will now be described.

(C: about 0.03 to 0.10 wt %)

Carbon is a constituent useful for improving the hot-rolled texture by phase transformation of iron. It is useful also for generating grains having Goss orientation. In order to cause carbon to effectively display these functions, it is necessary for the material to contain carbon in an amount of at least about 0.03 wt %. With a carbon content of over about 0.10 wt %, however, defective decarburization is caused even by decarburization annealing, and normal secondary recrystallization is prevented. The carbon content should therefore be limited within a range of from about 0.03 to about 0.10 wt %.

(Si: about 2.0 to 5.0 wt %)

Silicon causes an increase in electric resistance and reduces the iron loss. This is a constituent necessary for making it possible to stabilize the body-centered cubic lattice structure of the iron and to apply a high-temperature heat treatment. In order to obtain these effects, it is necessary for a material to contain silicon in an amount of at least about 2.0 wt %. However, a content of over about 5.0 wt % makes it difficult to perform cold rolling. The silicon content should therefore be limited within a range of from about 2.0 to 5.0 wt %.

(Mn: about 0.04 to 0.15 wt %)

Manganese effectively contributes to improvement of hot brittleness of steel. Further, when sulfur or selenium is mixed, manganese forms precipitates such as MnS or MnSe. These precipitates serve as inhibitors. A manganese content of under about 0.04 wt % has insufficient function as inhibitor. With a manganese content of over about 0.15 wt %, on the other hand, precipitates such as MnSe become coarse and lose their effect as inhibitors. The manganese content should therefore be limited within a range of from about 0.04 to 0.15 wt %.

(S and/or Se: about 0.01 to 0.03 wt %)

Sulfur and selenium are useful constituents serving as inhibitors as a second dispersed phase in steel through formation of MnSe, MnS, $Cu_{2-x}Se$ or $Cu_{2-x}S$ in combination with manganese or copper. A total content of sulfur and selenium of under about 0.01 wt % gives only a limited effect of addition. With a total content of over about 0.04 wt %, on the other hand, a solid solution is incomplete by slab heating, and also causes a defective product surface. The content of sulfur and/or selenium should therefore be limited within a range of from about 0.01 to 0.03 wt %.

(soluble Al: about 0.015 to 0.035 wt %)

Aluminum is a useful constituent functioning as an inhibitor through formation of AlN acting as a second dispersed phase. An amount of added aluminum of under about 0.015 wt % cannot ensure a sufficient amount of precipitation. When the amount of addition is over about 0.035 wt %, on the other hand, AlN is precipitated in a coarse form and loses its function as an inhibitor. The soluble aluminum content should therefore be limited within a range of from about 0.015 to 0.035 wt %.

(N: about 0.0050 to 0.010 wt %)

Nitrogen is also a constituent necessary for forming AlN just as aluminum. With an amount of added nitrogen of under about 0.0050 wt %, precipitation of AlN is insufficient. Addition of nitrogen in an amount of over about 0.010 wt % causes swelling on the surface during slab heating. The nitrogen content should therefore be limited within a range of from about 0.0050 to 0.010 wt %.

(Bi: about 0.001 to 0.070 wt %)

Bismuth is found to be preferentially concentrated on grain boundaries of primary recrystallization grains. It reduces mobility of grain boundaries during annealing. As a result, addition of bismuth causes an increase in secondary recrystallization temperature, thus providing secondary recrystallization grains integrated in the Goss orientation and improving the magnetic flux density. These functions are similar to those of antimony and arsenic. Bismuth is advantageous in that its solubility in iron is particularly low, and its melting point is as low as about 271° C. This is considered to result in a superior function of segregating on grain boundaries, as compared with antimony and arsenic. This is considered to lead to a remarkable effect of imparting a normal grain growth inhibiting ability, and to effectively act for improvement of orientational integration.

Bismuth, having a grain boundary segregating type inhibiting function intensifying constituent as antimony and the like, is considered to have a function of uniformly improving the magnetic property of a grain oriented electromagnetic steel sheet using inhibitors such as MnSe, MnS or AlN+(MnSe, MnS).

With a bismuth content of under about 0.001 wt %, the aforementioned normal grain growth inhibiting effect based on grain boundary segregation cannot fully be realized. Because of a very low solubility in iron, it is difficult successfully to add bismuth in an amount of over about 0.07 wt %. The amount of added bismuth should therefore be limited within a range of from about 0.001 to 0.07 wt %. (Sn: about 0.02 to 0.5 wt %, Ni: about 0.05 to 0.5 wt %, Cr: about 0.05 to 0.5 wt %, Ge: about 0.001 to 0.1 wt %)

In addition to the above-mentioned basic constituents, a high magnetic flux density $B_8$ can be stably obtained by adding one or more materials selected from the group consisting of from about 0.02 to 0.5 wt % tin, from about 0.05 to 0.5 wt % nickel, from about 0.05 to 0.5 wt % chromium and from about 0.001 to 0.1 wt % germanium to steel. Presence of these solid-solution type inhibitor elements is considered to intensify the normal grain growth inhibiting effect of bismuth. This effect is fully displayed only when deterioration of the inhibitor effect of bismuth is prevented by satisfying all the requirements set forth in the invention including the amount of coated annealing separator, the amount of MgO hydration, the decarburization annealing atmosphere and the hot rolling conditions. When the amounts of addition of these elements are under the above-mentioned ranges, the effect of intensifying the inhibiting function of bismuth is not realized. When the amounts of addition are above these ranges, on the other hand, the effect is saturated, and disadvantages are encountered such as a decrease in the saturated magnetic flux density and deterioration of surface quality. These elements should therefore preferably be added in amounts within the aforementioned ranges.

In addition, individual or composite addition of antimony, arsenic, molybdenum, copper, phosphorus, boron, tellurium, vanadium or niobium for reinforcing the inhibiting power is effective for further improving the magnetic property.

Antimony and arsenic have a function of improving the inhibiting power by segregating on grain boundaries as in the case of bismuth. These elements should preferably be added in an amount within a range of from about 0.001 to 0.10 wt %.

Molybdenum has a function of making acute the nuclei of secondary recrystallization grains in Goss orientation. The effect is particularly remarkable within a range of from about 0.001 to 0.20 wt %.

Copper is, as manganese, an element forming precipitates in combination with selenium or sulfur and thus improving the inhibiting power. The effect is remarkable within a range of from about 0.01 to 0.30 wt %.

Phosphorus is, as antimony, a constituent improving the inhibiting power by segregating on grain boundaries. A content of under about 0.010 wt % gives only an insufficient effect. A content of over about 0.030 wt % leads to instable magnetic property and surface quality. The phosphorus content should therefore be within a range of from about 0.010 to 0.030 wt %.

Boron, tellurium, vanadium and niobium have a function of further increasing the normal grain growth inhibiting power by forming precipitates such as BN, MnTe, Vn, NbN and NbC in steel. Boron should preferably be added within a range of from about 0.0010 to 0.010 wt %, and vanadium, niobium and tellurium, within a range of from about 0.005 to 0.10 wt %, respectively.

The main manufacturing steps of the present invention will now be described.

First, regarding the hot rolling conditions, the cooling rate after hot rolling is an important factor. An insufficient cooling rate after hot rolling makes it impossible for bismuth and AlN in the hot-rolled sheet to be uniformly dispersed, and this results in deterioration of the inhibiting power of the material which becomes non-uniform at different portions. This is considered to cause an insufficient and non-uniform secondary recrystallization, thus causing an unstable magnetic property. According to the results of experiments, the average cooling rate immediately after the end of hot rolling (for five seconds) should be at least about 30° C./sec. On the other hand, a cooling rate of over about 120° C./sec tends to cause a defective shape of the strip. The upper limit should therefore be about 120° C./sec.

For the decarburization annealing conditions, various factors are important. In the case of bismuth enhanced silicon steel, the result of our studies reveals that deterioration of the inhibitor in the surface region of the sheet during the final finishing annealing tends to cause deterioration of the magnetic property. As shown in FIG. 6, magnetic flux density $B_8$ becomes stable at a high level by keeping a high $P_{H2O}/P_{H2}$ in the soaking step of decarburization annealing to some extent. This is attributable to sufficient formation of an oxide film ($SiO_2$, $Fe_2SiO_4$) on the surface of the decarburization-annealed steel sheet which inhibits oxidation of the inhibitor (AN, bismuth) on the surface layer, thereby permitting stable secondary recrystallization. A $P_{H2O}/P_{H2}$ becoming too high leads again to a decrease in magnetic flux density. This is considered to be due to the fact that excessive surface oxidation of the decarburization-annealed sheet causes a decrease in uniformity of the surface oxide layer, leading to a decrease in protectivity for the atmosphere. From the point of view of preventing deterioration of the inhibitor during the final finishing annealing and ensuring uniformity of the surface oxide layer of the decarburization annealed sheet, therefore, the value of $P_{H2O}/P_{H2}$ for the soaking step of decarburization annealing should be limited within a range of from 0.45 to 0.70 (FIG. 6).

In order to stably obtain a satisfactory magnetic property with a bismuth-added material, however, the two aforementioned manufacturing conditions alone would be insufficient, and it is necessary to incorporate a treatment for inhibiting decomposition of the surface layer inhibitor during the final finishing annealing.

The amount of oxygen on the surface of the final finishing-annealed sheet is one of the indicators showing the extent of decomposition of the surface layer inhibitor during the final finishing annealing. The appropriate range of the amount of oxygen on the surface of the final finishing-annealed sheet will therefore be described.

The magnetic property of a bismuth-added material is considered susceptible to the effect of decomposition of the inhibitor during the final finishing annealing. In order to prevent this, only ensuring oxidizing property of the decarburization annealing atmosphere is not sufficient for a bismuth-added material, although it is effective for materials to which bismuth was not added. In the case of bismuth-added material, formation of the forsterite film during final finishing annealing exerts a remarkable effect on secondary recrystallization. For the purpose of inhibiting decomposition of the surface layer inhibitor, the amount of surface oxygen a per single side of the final finishing-annealed sheet should preferably be up to about 1.5 $g/m^2$.

When the inhibitor effect of bismuth is reinforced by adding tin, nickel, chromium or germanium into steel, a satisfactory magnetic property is achievable even with an amount of surface oxygen a of the final finishing-annealed sheet of over about 1.5 $g/m^2$.

In order to reduce the amount of surface oxidation a of the final finishing-annealed sheet, it is also effective to use an annealing separator comprising $Al_2O_3$, $SiO_2$, CaO, $Sb_2O_3$ or a metal chloride individually or compositely mixed with MgO for stabilization of the magnetic property.

For inhibiting decomposition of the surface layer inhibitor during the final finishing annealing, there are available methods of controlling the decarburization annealing atmosphere or the annealing separator.

First, the method of controlling the decarburization annealing atmosphere will be described.

The magnetic flux density is improved by applying a lower ratio $P_{H2O}/P_{H2}$ for the heating step than that for the soaking step in decarburization annealing, and further, applying a value lower by a certain value than the $P_{H2O}/P_{H2}$ ratio for the soaking step. This is attributable to the improved uniformity of subscale on the decarburization-annealed sheet and to the promoted effect of inhibiting bismuth oxidation in the surface layer as described above. With a view to obtaining this effect, the value of $P_{H2O}/P_{H2}$ for the heating step should preferably be lower than that for the soaking step. More preferably, assuming that $P_{H2O}/P_{H2}$ in the atmosphere for the heating step is represented by X1, and that in the atmosphere for the soaking step, by X2, it is desirable to perform control with a range satisfying $X2-0.25 \leqq X1 \leqq X2-0.05$. The value of $P_{H2O}/P_{H2}$ in the atmosphere for the heating step can be evaluated, for example, by averaging values of $P_{H2O}/P_{H2}$ within a region corresponding to a temperature region of about 30 to 90% of the soaking temperature (unit:centigrade). Improvement of magnetic flux density $B_8$ is available by using a temperature for the latter half of the soaking step of decarburization annealing within a range of from about 820 to 920° C. and a reducing atmosphere having a $P_{H2O}/P_{H2}$ ratio of up to about 0.15. This is considered to be due to the improvement of subscale density of the decarburization-annealed sheet brought about by the reduction of the oxide layer of the surface of the decarburization-annealed sheet. It is therefore desirable to use a temperature for the latter half of the soaking step of decarburization annealing within a range of from about 820 to 920° C. and the $P_{H2O}/P_{H2}$ ratio of the atmosphere of up to about 0.15. A period of time shorter than five seconds for this treatment leads to insufficient reduction of the surface of the decarburization-annealed sheet. With a period of over about 200 seconds, it is difficult to ensure a sufficient period of time for the treatment in an oxidizing atmosphere. The treatment time should therefore preferably be within a range of from about 5 to 200 seconds.

It is also desirable to employ a reducing atmosphere for the latter half of the soaking step of decarburization annealing, and a lower $P_{H2O}/P_{H2}$ in the atmosphere for the heating step than that in the soaking step except for the latter half, most preferably lower by about 0.05 to 0.25. A synergistic effect of the subscale uniformity and the reducing treatment of the subscale surface brought about by the optimization of the heating step further densities the subscale and have a function of bringing secondary recrystallization closer to the ideal state.

The method of controlling the annealing separator will now be described.

In order to improve the magnetic property by reducing the amount of surface oxygen of the final finishing-annealed sheet of a bismuth-added material, it is effective to reduce the amount of water introduced between layers of the final finishing-annealed coil through adjustment of the amount of coated annealing separator and the amount of MgO hydration. That is, by assuming that the amount of MgO hydration is represented by X (wt %), and the amount of coated separator per single side of steel sheet after coating and drying, by Y ($g/m^2$), the formula: $Y \leqq -3X+15$ should preferably be satisfied.

It is known that addition of an appropriate amount of $TiO_2$ into the annealing separator accelerates film formation during final finishing annealing, thereby permitting achievement of a satisfactory appearance of product. Usually, $TiO_2$ is added in an amount within a range of from about 10 to 15 wt % relative to 100 weight parts of MgO. While $TiO_2$ contributes to film formation as an oxygen source in the annealing separator, and excessive film formation with the bismuth-added material tends to cause decomposition of the surface layer inhibitor and deterioration of the magnetic property. It is therefore desirable, as shown in FIG. 7, to limit the amount of $TiO_2$ added into the annealing separator to up to about 10 weight parts relative to about 100 weight parts of MgO. Adding a compound of strontium, antimony, boron, zirconium, niobium or chromium which are known assistants to the annealing separator is effective for improving the film properties.

The soaking temperature of decarburization annealing is considered to exert an effect of decarburization property and primary recrystallized grain size of the decarburization-annealed sheet. Applying a soaking temperature of decarburization annealing within a range of from 800 to 900° C. is considered to lead to sufficient removal of carbon in steel, enabling the primary recrystallized grain size of the decarburization-annealed sheet to take a value appropriate for secondary recrystallization. As a result, it is relatively easy to obtain a high and stable magnetic flux density. With a soaking temperature of decarburization annealing of outside the aforementioned range, more carbon remains in the steel, and the primary grain size becomes too small or too large: an ideal secondary recrystallization texture is unavailable and the magnetic property of the product tends to deteriorate. For these reasons, the soaking temperature during decarburization annealing should preferably be limited within a range of from about 800 to 900° C.

Even when hot-rolled sheet annealing or intermediate annealing is omitted, the effects of the aforementioned manufacturing conditions sufficiently serve to improve the magnetic property. There is therefore imposed no particular limitation on the presence of hot-rolled sheet annealing or intermediate annealing. The present invention is therefore applicable to any process of hot-rolled sheet annealing and then achieving a final thickness through two or more runs of cold rolling including an intermediate annealing, a process of achieving a final thickness through two or more runs of cold rolling including an intermediate annealing without applying hot-rolled sheet annealing, and a process conducting hot-rolled annealing and then achieving a final thickness through a single run of cold rolling.

Applying magnetic domain refining to a grain oriented electromagnetic steel sheet based on the above-mentioned manufacturing conditions is very important for reducing the iron loss, and magnetic domain refining is effectively applicable in the invention. Applicable methods for magnetic domain refining include a method of introducing linear strain by means of a laser beam, as disclosed in Japanese Examined Patent Publication No. 57-2252, or by means of a plasma flame as disclosed in Japanese Unexamined Patent Publication No. 62-96617, and the introduction of a linear notch in a direction substantially perpendicular to the rolling direction prior to final finishing annealing as disclosed in Japanese Examined Patent Publication No. 3-69968. It is also possible to obtain a material having a very low iron loss by mirror-surface-treating the surface of a final finishing-annealed sheet obtained by the method of the present invention and then artificially forming a tensile coating, or by combining a magnetic domain refining.

In the final product, the contents of carbon, sulfur, selenium, nitrogen and aluminum are considerably reduced from the contents thereof in the slab under the effect of decarburization annealing and the purifying treatment in final finishing annealing. The minimum C content in the product is about 2 ppm in the usual industrial process. The manganese and bismuth contents also decrease during finishing annealing, but remain to some degree in the product. The silicon content shows almost no change from that in the slab. The product therefore comprises up to about 0.0040 wt % carbon, from about 2.0 to 5.0 wt % silicon, from about 0.02 to 0.15 wt % manganese, up to about 0.0025 wt % sulfur and/or selenium, up to about 0.0015 wt % aluminum, up to about 25 wtppm nitrogen, and from about 0.0002 to 0.0600 wt % bismuth. Further, According to the manufacturing method of the invention, the average value θ of the shift angle between the [001] grain axis and the rolling direction in the portion of the product coil except for 200 mm from both width ends of the product coil, is about 5° or less.

EXAMPLES

Example 1

A silicon steel slab comprising 0.060 wt % carbon, 3.30 wt % silicon, 0.070 wt % manganese, 0.020 wt % aluminum, 0.0075 wt % nitrogen, 0.0040 wt % antimony, 0.020 wt % selenium, 0.020 wt % molybdenum and 0.001 wt % sulfur, and containing bismuth in an amount of 0 wt %, 0.001 wt %, 0.030 wt %, or 0.060 wt %, and the balance substantially iron was heated by induction heating to 1,400° C. for 60 minutes, and then hot rolled to a hot-rolled thickness of 2.5 mm. Cooling was applied at cooling rate of 50° C./sec during five seconds immediately after the end of the final pass of hot rolling. Then, the hot-rolled sheet was subjected to hot-rolled sheet annealing at 950° C. for one minute, pickling, and primary cold rolling into a cold-rolled sheet having a thickness of 1.6 mm. Subsequently, the cold-rolled sheet was subjected to intermediate annealing at 1,050° C. for one minute, pickling, and then secondary cold rolling into a cold-rolled sheet having a final thickness of 0.23 mm. The cold-rolled sheet was then subjected to decarburization annealing at 850° C. for 100 seconds with two levels of $P_{H2O}/P_{H2}$ in the soaking step of 0.40 and 0.55. Then, an annealing separator prepared by adding 10 wt % $TiO_2$ to MgO of which the amount of hydration was adjusted to 3.0 wt % was coated onto the surface of the decarburization-annealed sheet in amounts of two levels including 4.0 g/m$^2$ and 8.0 g/m$^2$. Subsequently, final finishing annealing was applied to the decarburization-annealed sheet at a maximum temperature of 1,200° C. for five hours. The amount of surface oxygen σ of the resultant finishing-annealed sheet was measured. Then, an insulating tensile coating mainly comprising magnesium phosphate containing colloidal silica was applied to the final finishing-annealed sheet into a product sheet. Linear strain areas were introduced into the product sheet at intervals of 7 mm relative to the rolling direction at an angle of 900 to the rolling direction by means of a plasma flame.

Epstein test pieces (280L×30W) corresponding to 500 g were cut in parallel with the rolling direction from the product obtained as described above to measure the magnetic flux density $B_8$ and the iron loss $W_{17/50}$ by the Epstein test method. The resultant magnetic property of the product is shown in Table 1. In the grain oriented electromagnetic steel sheet manufactured under conditions meeting the present invention, a product having a very high magnetic flux density magnetic flux density $B_8$ was obtained. The final product of this example contained up to 0.0035 wt % carbon, 3.24 wt % silicon, 0.055 wt % manganese, 0.0001 wt % sulfur, 0.0007 wt % selenium, 0.0010 wt % aluminum and 7 wtppm nitrogen in the substrate. The bismuth contents were 0.0004 wt %, 0.0182 wt % and 0.0394 wt %, respectively, for the amounts of added bismuth of 0.0001 wt %, 0.030 wt % and 0.060 wt %. The final product of this example had an average value θ of shift angle between the [001] grain axis and the rolling direction in the portion of the product coil excluding 200 mm from the both ends of the product coil within a range of from 2.0 to 3.1°.

TABLE 1

| Symbol | Amount of added Bi (wt %) | $P_{H2O}/P_{H2}$ in decarburization annealing atmosphere | Amount of coated separator (g/m$^2$) | Amount of surface oxygen of final finishing-annealed sheet (g/m$^2$ per side) | $B_8$ (T) | $W_{17/50}$ (W/kg) | Remarks |
|---|---|---|---|---|---|---|---|
| 1A | 0 | 0.040 | 4 | 1.08 | 1.905 | 0.871 | Comparative example |
| 1B | 0 | 0.040 | 8 | 2.15 | 1.940 | 0.762 | Comparative example |
| 1C | 0 | 0.055 | 4 | 1.12 | 1.910 | 0.865 | Comparative example |
| 1D | 0 | 0.055 | 8 | 2.26 | 1.935 | 0.776 | Comparative example |
| 1E | 0.001 | 0.040 | 4 | 1.10 | 1.925 | 0.789 | Comparative example |
| 1F | 0.001 | 0.040 | 8 | 2.18 | 1.911 | 0.866 | Comparative example |

TABLE 1-continued

| Symbol | Amount of added Bi (wt %) | $P_{H2O}/P_{H2}$ in decarburization annealing atmosphere | Amount of coated separator ($g/m^2$) | Amount of surface oxygen of final finishing-annealed sheet ($g/m^2$ per side) | $B_8$ (T) | $W_{17/50}$ (W/kg) | Remarks |
|---|---|---|---|---|---|---|---|
| 1G | 0.001 | 0.055 | 4 | 1.15 | 1.970 | 0.662 | Example of the Invention |
| 1H | 0.001 | 0.055 | 8 | 2.29 | 1.878 | 0.942 | Comparative example |
| 1I | 0.030 | 0.040 | 4 | 1.29 | 1.935 | 0.769 | Comparative example |
| 1J | 0.030 | 0.040 | 8 | 2.22 | 1.930 | 0.771 | Comparative example |
| 1K | 0.030 | 0.055 | 4 | 1.37 | 1.979 | 0.643 | Example of the Invention |
| 1L | 0.030 | 0.055 | 8 | 2.31 | 1.936 | 0.748 | Comparative example |
| 1M | 0.060 | 0.040 | 4 | 1.19 | 1.942 | 0.746 | Comparative example |
| 1N | 0.060 | 0.040 | 8 | 2.31 | 1.929 | 0.779 | Comparative example |
| 1O | 0.060 | 0.055 | 4 | 1.30 | 1.986 | 0.634 | Example of the Invention |
| 1P | 0.060 | 0.055 | 8 | 2.29 | 1.952 | 0.722 | Comparative example |

Example 2

A silicon steel slab comprising 0.065 wt % carbon, 3.40 wt % silicon, 0.065 wt % manganese, 0.05 wt % copper, 0.022 wt % aluminum, 0.0082 wt % nitrogen, 0.02 wt % molybdenum, 0.016 wt % selenium, 0.009 wt % sulfur, 0.045 wt % bismuth and the balance iron was heated by induction heating to 1,400° C. for 60 minutes, and then, hot-rolled to a hot-rolled sheet having a thickness of 2.5 mm. Four levels of cooling rate of 20° C./sec, 30° C./sec, 60° C./sec and 100° C./sec were provided for five seconds immediately after the end of the final pass of hot rolling. Subsequently, hot-rolled sheet annealing was applied to the hot-rolled sheet at 950° C. for a minute, and after pickling, the sheet was subjected to primary cold rolling into a cold-rolled sheet having a thickness of 1.6 mm. Subsequently, the cold-rolled sheet was subjected to intermediate annealing at 1,050° C. for one minute, pickling, and then secondary cold rolling into a cold-rolled sheet having a final thickness of 0.23 mm. The cold-rolled sheet was then subjected to decarburization annealing at 850° C. for 100 seconds with two levels of $P_{H2O}/P_{H2}$ in the soaking step of 0.40 and 0.55. Then, an annealing separator comprising MgO having an amount of hydration of 0.8 wt % was coated onto the surface of the decarburization-annealed sheet in an amount of 4.0 $g/m^2$. Subsequently, final finishing annealing was applied to the decarburization-annealed sheet at a maximum temperature of 1,200° C. for five hours. The amount of surface oxygen of the resultant final finishing-annealed sheet was measured. Then, after hydrochloric acid pickling, the surface of the final finishing-annealed sheet was mirror-surface treated through electrolytic polishing in an NaCl bath, and then, a tension was imparted to the steel sheet surface by vapor-depositing TiN onto the steel sheet surface. Then, an insulating coating mainly comprising magnesium phosphate containing colloidal silica was applied. Further, linear strain areas were introduced into the product sheet at intervals of 5 mm relative to the rolling direction at an angle of 85° to the rolling direction by means of a plasma flame. Epstein test pieces corresponding to 500 g were cut from the product obtained, to measure the magnetic flux density $B_8$ and the iron loss $W_{17/50}$ by the Epstein test method. The resultant magnetic property of the product is shown in Table 2. In the grain oriented electromagnetic steel sheet manufactured under conditions meeting the present invention, a product having a very excellent magnetic property was stably obtained. The final product of this example contained up to 0.0030 wt % carbon, 3.33 wt % silicon, 0.058 wt % manganese, 0.0003 wt % sulfur, 0.0010 wt % selenium, 0.007 wt % aluminum, 5 wtppm nitrogen and 0.0222 wt % bismuth in the substrate. The final product of this example had an average shift angle value θ within a range of from 1.9 to 2.9°.

TABLE 2

| Symbol | Average cooling rate (° C./s) immediately after hot rolling (for 5 sec) | $P_{H2O}/P_{H2}$ during decarburization annealing | Amount of surface oxygen of final finishing-annealed sheet ($g/m^2$ per side) | $B_8$ (T) | $W_{17/50}$ (W/kg) | Remarks |
|---|---|---|---|---|---|---|
| 2A | 20 | 0.040 | 0.61 | 1.935 | 0.652 | Comparative example |
| 2B | 30 | 0.040 | 0.65 | 1.942 | 0.642 | Comparative example |

TABLE 2-continued

| Symbol | Average cooling rate (° C./s) immediately after hot rolling (for 5 sec) | $P_{H20}/P_{H2}$ during decarburization annealing | Amount of surface oxygen of final finishing-annealed sheet (g/m$^2$ per side) | $B_8$ (T) | $W_{17/50}$ (W/kg) | Remarks |
|---|---|---|---|---|---|---|
| 2C | 60 | 0.040 | 0.68 | 1.945 | 0.644 | Comparative example |
| 2D | 100 | 0.040 | 0.64 | 1.939 | 0.638 | Comparative example |
| 2E | 20 | 0.050 | 0.59 | 1.928 | 0.667 | Comparative example |
| 2F | 30 | 0.050 | 0.57 | 1.975 | 0.501 | Example of the Invention |
| 2G | 60 | 0.050 | 0.56 | 1.981 | 0.487 | Example of the Invention |
| 2H | 100 | 0.050 | 0.60 | 1.985 | 0.477 | Example of the Invention |

Example 3

A silicon steel slab comprising 0.065 wt % carbon, 3.30 wt % silicon, 0.065 wt % manganese, 0.05 wt % copper, 0.025 wt % aluminum, 0.0075 wt % nitrogen, 0.02 wt % molybdenum, 0.015 wt % selenium, 0.010 wt % sulfur, 0 wt % or 0.020 wt % bismuth, and the balance iron was heated by induction heating at 1,400° C. for 60 minutes, and then hot-rolled into a hot-rolled sheet having a thickness of 2.5 mm. The hot-rolled sheet was cooled at a cooling rate of 60° C./sec for five seconds immediately after the end of the final pass of hot rolling. Then the hot-rolled sheet was pickled without hot-rolled sheet annealing, and subjected to primary cold rolling into a cold-rolled sheet having a thickness of 1.6 mm. Subsequently, the cold-rolled sheet was subjected to intermediate annealing at 1,050° C. for one minute, pickled, and cold-rolled by secondary cold rolling into a cold-rolled sheet having a final thickness of 0.27 mm. Then, grooves each having an angle with the rolling direction of 85°, a width of 100 $\mu$m, and a width of 25 $\mu$m at intervals of 3.0 mm in the rolling direction were formed on the cold-rolled sheet by resist etching, and then, decarburization annealing was applied at 850° C. for 100 seconds. $P_{H2O}/P_{H2}$ in the soaking step of decarburization annealing was 0.43 or 0.65. Then, an annealing separator mainly comprising MgO of an amount of hydration of 3.0 wt % and added with 7 weight parts or 12 weight parts $TiO_2$ relative to 100 weight parts MgO was coated onto the surface of the decarburization-annealed sheet in an amount of coating of 4.0 g/m$^2$ per single side. Then, final finishing annealing was applied at a maximum temperature of 1,200° C. for five hours, and an insulating coating mainly comprising magnesium phospate containing colloidal silica was applied to obtain a product. Epstein test pieces corresponding to 500 g were cut from the thus obtained product to measure the magnetic flux density $B_8$ and the iron loss $W_{17/50}$ by the Epstein test method.

The magnetic property of the result product is shown in Table 3. In the grain oriented electromagnetic steel sheet manufactured under the conditions of the present invention, there is stably created a product having a very excellent magnetic property.

The final product of this example of the invention contained up to 0.0020 wt % carbon, 3.24 wt % silicon, 0.060 wt % manganese, 0.0008 wt % sulfur, 0.0009 wt % selenium, 0.0010 wt % aluminum, 5 wtppm nitrogen, and 0.0012 wt % bismuth in the substrate thereof. The final product of this example had an average value θ of shift angle of 2.2°.

TABLE 3

| Symbol | Amount of added Bi (wt %) | $P_{H20}/P_{H2}$ during decarburization annealing | Amount of added $TiO_2$ (relative to 100 g MgO in g) | Amount of surface oxygen of final finishing-annealed sheet (g/m$^2$ per side) | $B_8$ (T) | $W_{17/50}$ (W/kg) | Remarks |
|---|---|---|---|---|---|---|---|
| 3A | 0 | 0.43 | 7 | 0.95 | 1.884 | 0.785 | Comparative example |
| 3B | 0 | 0.43 | 14 | 1.64 | 1.876 | 0.819 | Comparative example |
| 3C | 0 | 0.65 | 7 | 1.04 | 1.881 | 0.786 | Comparative example |
| 3D | 0 | 0.65 | 14 | 1.71 | 1.895 | 0.761 | Comparative example |
| 3E | 0.02 | 0.43 | 7 | 0.98 | 1.883 | 0.778 | Comparative example |
| 3F | 0.02 | 0.43 | 14 | 1.74 | 1.881 | 0.762 | Comparative example |

TABLE 3-continued

| Symbol | Amount of added Bi (wt %) | $P_{H2O}/P_{H2}$ during decarburization annealing | Amount of added $TiO_2$ (relative to 100 g MgO in g) | Amount of surface oxygen of final finishing-annealed sheet ($g/m^2$ per side) | $B_8$ (T) | $W_{17/50}$ (W/kg) | Remarks |
|---|---|---|---|---|---|---|---|
| 3G | 0.02 | 0.65 | 7 | 0.92 | 1.934 | 0.648 | Example of the Invention |
| 3H | 0.02 | 0.65 | 14 | 1.82 | 1.891 | 0.743 | Comparative example |

Example 4

A silicon steel slab comprising 0.060 wt % carbon, 3.25 wt % silicon, 0.072 wt % manganese, 0.020 wt % aluminum, 0.0075 wt % nitrogen, 0.030 wt % antimony, 0.020 wt % molybdenum, 0.020 wt % selenium, 0.001 wt % sulfur, 0 wt % or 0.030 wt % bismuth and balance iron was heated by induction heating at 1,400° C. for 60 minutes, and then hot-rolled into a hot-rolled sheet having a thickness of 2.3 mm. The hot-rolled sheet was cooled at a cooling rate of 70° C./sec for five seconds immediately after the end of the final pass of hot rolling. Then, the hot-rolled sheet was subjected to hot-rolled sheet annealing at 1,050° C. for one minute, pickled, and cold-rolled into a final thickness of 0.27 mm. Then, grooves each having an angle with the rolling direction of 80°, a width of 100 μm, and width of 25 μm at intervals of 3.0 mm in the rolling direction were formed on the cold-rolled sheet by resist etching, and then, decarburization annealing was applied at 870° C. for 80 seconds, with a $P_{H2O}/P_{H2}$ in the heating step of 0.60. Then, an annealing separator prepared by adding 6.0 weight parts $TiO_2$ and 2 weight parts $SnO_2$ relative to 100 weight parts MgO to MgO having an amount of hydration of 2.0 wt % or 4.0 wt % onto the surface of the decarburization-annealed sheet in an amount of coating of 6.0 $g/m^2$, and the final finishing annealing was applied at a maximum temperature of 1,200° C. for five hours. Subsequently, an insulating coating mainly comprising magnesium phosphate containing colloidal silica was applied to the final finishing-annealed sheet to complete a product. Epstein test pieces corresponding to 500 g was cut from the thus obtained product to measure the magnetic flux density $B_8$ and the iron loss $W_{17/50}$ by the Epstein test method. The magnetic property of the resultant product is shown in Table 4. In the grain oriented electromagnetic steel sheet manufactured under conditions meeting the present invention, there is stably created a product having a very excellent magnetic property.

The final product of this example of the invention contained up to 0.0012 wt % carbon, 3.20 wt % silicon, 0.052 wt % manganese, 0.0003 wt % sulfur, 0.0013 wt % selenium, 0.0009 wt % aluminum, 6 wtppm nitrogen and 0.0031 wt % bismuth in the substrate thereof. Further, the final product of this example had an average value θ of shift angle of 0.9°.

TABLE 4

| Symbol | Amount of added Bi (wt %) | Amount of MgO hydration (wt %) | Amount of surface oxygen of final finishing-annealed sheet ($g/m^2$ per side) | $B_8$ (T) | $W_{17/50}$ (W/kg) | Remarks |
|---|---|---|---|---|---|---|
| 4A | 0 | 2 | 1.38 | 1.879 | 0.886 | Comparative example |
| 4B | 0 | 4 | 1.81 | 1.888 | 0.843 | Comparative example |
| 4C | 0.03 | 2 | 1.24 | 1.935 | 0.700 | Example of the Invention |
| 4D | 0.03 | 4 | 1.75 | 1.876 | 0.894 | Comparative example |

Example 5

A silicon steel slab having a chemical composition as shown in Table 5 and the balance substantially iron was heated by induction heating to 1,400° C. for 60 minutes, and hot-rolled into a hot-rolled sheet having a thickness of 2.3 mm. The hot-rolled sheet was cooled at an average cooling rate of 50° C./sec for five seconds immediately after the end of the final pass of hot rolling. Subsequently, the hot-rolled sheet was subjected to hot-rolled sheet annealing at 950° C. for one minute, pickled, and then to primary cold rolling into a thickness of 1.6 mm. After applying intermediate annealing at 1,050° C. for one minute and pickling, the sheet was subjected to secondary cold rolling into a cold-rolled sheet having a final thickness of 0.23 mm. Then, decarburization annealing of the cold-rolled sheet was applied with a $P_{H2O}/P_{H2}$ ratio in the soaking step of 0.50 (dew point: 66.1° C., $H_2$: $N_2$=70:30) at 850° C. for 100 seconds. Then, an annealing separator prepared by adding five weight parts $TiO_2$ relative to 100 weight parts MgO to MgO having an amount of hydration adjusted to 2.0 wt % or 4.0 wt % was coated onto the surface of the decarburization-annealed sheet in an amount of coating of 5.0 g/m2 per single side of steel sheet. Subsequently, the coated sheet was subjected to final-finishing annealing at a maximum temperature of 1,200° C. for five hours. Then, an insulating coating mainly comprising magnesium phosphate containing colloidal silica was applied to the finishing-annealed sheet. Then, linear strain areas were introduced by means of a plasma flame at an angle to the rolling direction of 80° at intervals of 7 mm relative to the rolling direction to complete a product. Epstein test pieces corresponding to 500 g were cut from the thus obtained product to measure the magnetic flux density $B_8$ and the iron loss $W_{17/50}$ by the Epstein test method. The magnetic property of the resultant product is shown in Table 6. In the grain oriented electromagnetic steel sheet manufactured under conditions meeting the present invention, a product having a high magnetic flux density $B_8$ is obtained. Among others, with 5D, 5F, 5H, 5J, 5L, 5M, 5N, 5O, 5P and 5Q added with tin, nickel, chromium or germanium within the ranges of the present invention, products having very excellent magnetic properties as represented by $W_{17/50} \leqq 0.63$ W/kg were obtained.

The final product of this example of the invention contained from 0.0009 up to 0.0020 wt % carbon, from 3.29 to 3.37 wt % silicon, from 0.0050 to 0.0070 wt % manganese, from 0.0002 to 0.0015 wt % sulfur, from 0.0001 to 0.0012 wt % selenium, from 0.0005 to 0.0012 wt % aluminum, from 3 to 13 wtppm nitrogen, and 0.0002 to 0.0105 wt % bismuth in the substrate thereof. Further, the final product of this example had an average value θ of shift angle within a range of from 0.4 to 4.6°.

TABLE 5

| Symbol | weight % | | | | | | | | | | | | | | Within or out of scope of the Invention |
|---|---|---|---|---|---|---|---|---|---|---|---|---|---|---|---|
| | C | Si | Mn | Al | N | Cu | Mo | Se | S | Bi | Sn | Ni | Cr | Ge | |
| 5A | 0.068 | 3.35 | 0.07 | 0.023 | 0.0090 | tr | 0.015 | 0.017 | 0.003 | tr | tr | tr | tr | tr | Out |
| 5B | 0.065 | 3.36 | 0.08 | 0.025 | 0.0092 | tr | 0.015 | 0.018 | 0.002 | 0.012 | | | | | Within |
| 5C | 0.066 | 3.35 | 0.07 | 0.028 | 0.0089 | tr | 0.015 | 0.018 | 0.002 | 0.012 | 0.01 | | | | Within |
| 5D | 0.067 | 3.35 | 0.07 | 0.027 | 0.0090 | tr | 0.015 | 0.017 | 0.003 | 0.011 | 0.15 | | | | Within |
| 5E | 0.066 | 3.34 | 0.07 | 0.026 | 0.0090 | 0.10 | tr | 0.020 | 0.002 | 0.015 | | 0.02 | | | Within |
| 5F | 0.066 | 3.34 | 0.07 | 0.027 | 0.0089 | 0.10 | tr | 0.017 | 0.001 | 0.015 | | 0.15 | | | Within |
| 5G | 0.067 | 3.36 | 0.08 | 0.028 | 0.0087 | 0.10 | tr | 0.018 | 0.002 | 0.012 | | | 0.02 | | Within |
| 5H | 0.065 | 3.35 | 0.070 | 0.027 | 0.0087 | 0.10 | 0.015 | 0.020 | 0.002 | 0.015 | | | 0.15 | | Within |
| 5I | 0.066 | 3.32 | 0.080 | 0.026 | 0.0086 | 0.10 | 0.015 | 0.019 | 0.002 | 0.013 | | | | 0.0005 | Within |
| 5J | 0.066 | 3.31 | 0.070 | 0.027 | 0.0088 | 0.10 | 0.015 | 0.019 | 0.003 | 0.010 | | | | 0.0150 | Within |
| 5K | 0.065 | 3.37 | 0.08 | 0.028 | 0.0088 | 0.10 | tr | tr | 0.015 | tr | tr | tr | tr | tr | Out |
| 5L | 0.062 | 3.32 | 0.07 | 0.026 | 0.0087 | 0.10 | tr | tr | 0.016 | 0.006 | 0.15 | 0.10 | | | Within |
| 5M | 0.063 | 3.36 | 0.07 | 0.027 | 0.0091 | 0.10 | tr | tr | 0.017 | 0.004 | 0.15 | | 0.10 | | Within |
| 5N | 0.065 | 3.34 | 0.07 | 0.029 | 0.0090 | 0.10 | tr | tr | 0.015 | 0.003 | 0.15 | | | 0.100 | Within |
| 5O | 0.065 | 3.37 | 0.07 | 0.028 | 0.0092 | 0.10 | tr | tr | 0.014 | 0.007 | | 0.15 | 0.10 | | Within |
| 5P | 0.066 | 3.36 | 0.07 | 0.026 | 0.0089 | 0.10 | tr | tr | 0.015 | 0.008 | | 0.15 | | 0.100 | Within |
| 5Q | 0.069 | 3.3 | 0.08 | 0.026 | 0.0087 | 0.10 | tr | tr | 0.016 | 0.002 | 0.10 | 0.05 | 0.10 | 0.010 | Within |

TABLE 6

| Symbol | Amount of MgO hydration | | | |
|---|---|---|---|---|
| | 2.0% | | 4.0% | |
| | B8 (T) | W17/50 (W/kg) | B8 (T) | W17/50 (W/kg) |
| 5A | 1.926 | 0.812 | 1.931 | 0.801 |
| 5B | ⊙1.972 | 0.673 | 1.907 | 0.876 |
| 5C | ⊙1.976 | 0.663 | 1.912 | 0.867 |

TABLE 6-continued

| Symbol | Amount of MgO hydration | | | |
|---|---|---|---|---|
| | 2.0% | | 4.0% | |
| | B8 (T) | W17/50 (W/kg) | B8 (T) | W17/50 (W/kg) |
| 5D | ⊙1.991 | 0.612 | 1.921 | 0.843 |
| 5E | ⊙1.979 | 0.660 | 1.909 | 0.873 |
| 5F | ⊙1.993 | 0.605 | 1.923 | 0.831 |
| 5G | ⊙1.982 | 0.654 | 1.898 | 0.887 |
| 5H | ⊙1.992 | 0.604 | 1.900 | 0.871 |
| 5I | ⊙1.983 | 0.653 | 1.912 | 0.850 |
| 5J | ⊙1.990 | 0.614 | 1.925 | 0.809 |
| 5K | 1.933 | 0.798 | 1.921 | 0.823 |
| 5L | ⊙1.990 | 0.615 | 1.919 | 0.813 |
| 5M | ⊙1.991 | 0.620 | 1.923 | 0.799 |
| 5N | ⊙1.992 | 0.611 | 1.898 | 0.891 |
| 5O | ⊙1.992 | 0.619 | 1.901 | 0.876 |
| 5P | ⊙1.993 | 0.608 | 1.923 | 0.843 |
| 5Q | ⊙1.991 | 0.621 | 1.907 | 0.868 |

⊙ Example of the Invention

Example 6

A silicon steel slab comprising 0.060 wt % carbon, 3.30 wt % silicon, 0.070 wt % manganese, 0.020 wt % aluminum, 0.0075 wt % nitrogen, 0.030 wt % antimony, 0.020 wt % molybdenum, 0.020 wt % selenium, 0.005 wt % sulfur, 0.035 wt % bismuth and the balance iron was heated by induction heating to 1,400° C. for 60 minutes, and then, hot-rolled into hot-rolled sheet having a thickness of 2.5 mm. The hot-rolled sheet was cooled at a cooling rate of 60° C./sec for five seconds immediately after the end of the final pass of hot rolling. Subsequently, the hot-rolled sheet was subjected to hot-rolled sheet annealing at 950° C. for a minute, then pickled, and to primary cold rolling into a thickness of 1.6 mm. After applying intermediate annealing at 1,050° C. for a minute, the annealed sheet was pickled, and subjected to secondary cold rolling into a cold-rolled sheet having a final thickness of 0.23 mm. Then, decarburization annealing was applied to the cold-rolled sheet with three levels of average $P_{H2O}/P_{H2}$ in a the heating step of 0.25, 0.35 and 0.45, and three levels of $P_{H2O}/P_{H2}$ in the soaking step of 0.40, 0.55 and 0.75 at a soaking temperature of 850° C. for soaking period of 100 seconds. Subsequently, an annealing separator mainly comprising MgO was coated onto the decarburization-annealed sheet, and then, final finishing annealing was applied at a maximum temperature of 1,200° C. for five hours. Then, an insulating coating mainly comprising magnesium phosphate containing colloidal silica was applied to the finishing-annealed sheet to complete a product. Linear strain areas having an angle of 90° to the rolling direction were introduced by means of a plasma flame at intervals of 5 mm relative to the rolling direction.

Epstein test pieces corresponding to 500 g were cut from the thus obtained product to measure the magnetic flux density $B_8$ and the iron loss $W_{17/50}$ by the Epstein test method. The magnetic property of the resultant product is shown in Table 7. Table 7 suggests that, in the grain oriented electromagnetic steel sheet manufactured under conditions meeting the present invention, a product having a very high magnetic flux density $B_8$ is available.

The final product of the example of the invention contained up to 0.0015 wt % carbon, 3.26 wt % silicon, 0.055 wt % manganese, 0.0004 wt % sulfur, 0.0011 wt % selenium, 0.0007 wt % aluminum, 4 wtppm nitrogen and 0.0154 wt % bismuth in the substrate thereof. The final product of this example had an average value θ of shift angle within a range of from 2.0 to 4.7°.

TABLE 7

| Symbol | $P_{H2O}/P_{H2}$ During heating | $P_{H2O}/P_{H2}$ During soaking | $B_8$ (T) | $W_{17/50}$ (W/kg) | After plasma irradiation $W_{17/50}$ (W/kg) | Remarks |
|---|---|---|---|---|---|---|
| 6A | 0.25 | 0.40 | 1.921 | 0.906 | 0.830 | Comparative example |
| 6B | 0.30 | 0.40 | 1.933 | 0.886 | 0.790 | Comparative example |
| 6C | 0.45 | 0.40 | 1.948 | 0.860 | 0.742 | Comparative example |
| 6D | 0.25 | 0.55 | 1.969 | 0.820 | 0.670 | Example of the Invention |
| 6E | 0.30 | 0.55 | 1.980 | 0.880 | 0.620 | Example of the Invention |
| 6F | 0.45 | 0.55 | 1.984 | 0.905 | 0.602 | Example of the Invention |
| 6G | 0.25 | 0.75 | 1.948 | 0.873 | 0.731 | Comparative example |
| 6H | 0.30 | 0.75 | 1.945 | 0.869 | 0.743 | Comparative example |
| 6I | 0.45 | 0.75 | 1.942 | 0.883 | 0.739 | Comparative example |

Example 7

A silicon steel slab comprising 0.065 wt % carbon, 3.40 wt % silicon, 0.065 wt % manganese, 0.05 wt % copper, 0.025 wt % aluminum, 0.0075 wt % nitrogen, 0.030 wt % antimony, 0.020 wt % molybdenum, 0.015 wt % selenium, 0.010 wt % sulfur, 0 wt %, 0.020 wt % or 0.050 wt % bismuth and the balance iron is heated by induction heating to 1,400° C. for 60 minutes, and then hot-rolled into a hot-rolled sheet having a thickness of 2.5 mm. The hot-rolled sheet was cooled at a cooling rate of 25° C./sec or 60° C./sec for five seconds immediately after the end of the final pass of hot rolling. After applying hot-rolled sheet annealing to the hot-rolled sheet at 950° C. for one minute, the sheet was pickled, and then subjected to primary cold rolling into a thickness of 1.5 mm. Then, the sheet is subjected to intermediate annealing at 1,050° C. for one minute, to pickling, and then to secondary cold rolling into a cold-rolled sheet having a final thickness of 0.23 mm. Subsequently, grooves having a width of 100 μm and a depth of 25 μm were formed at intervals of 3.0 mm relative to the rolling direction at an angle of 90° to the rolling direction by resist etching on the cold-rolled sheet. Then, decarburization annealing was applied to the grooved sheet with a $P_{H2O}/P_{H2}$ of 0.60 in the heating step and a $P_{H2O}/P_{H2}$ of 0.60 in the soaking step, at 850° C. for 100 seconds. Subsequently, after coating an annealing separator mainly comprising MgO, final finishing annealing was applied at a maximum temperature of 1,200° C. for five hours, and an insulating coating mainly comprising magnesium phosphate containing colloidal silica was applied to complete a product. Epstein test pieces corresponding to 500 g were cut from the resultant product to measure the magnetic flux density $B_8$ and the iron loss $W_{17/50}$ by the Epstein test method. The magnetic property of the product is shown in Table 8. In the grain oriented electromagnetic steel sheet manufactured under conditions meeting the present invention, a product having a very excellent magnetic property was stably achieved.

The final product of this example of the invention contains up to 0.0034 wt % carbon, 3.35 wt % silicon, 0.058 wt % manganese, 0.0004 wt % sulfur, 0.0007 wt % selenium, 0.0011 wt % aluminum, 4 wtppm nitrogen, and 0.0005 to 0.0401 wt % bismuth in the substrate thereof. The final product of this example had an average value θ of shift angle within a range of from 2.0 to 4.0°.

TABLE 8

| Symbol | Amount of added Bi (%) | Cooling rate (° C./sec) during 5 sec immediately after hot rolling | $B_8$ (T) | $W_{17/50}$ (W/kg) | Remarks |
|---|---|---|---|---|---|
| 7A | 0.000 | 25 | 1.880 | 0.760 | Comparative example |
| 7B | 0.020 | 25 | 1.896 | 0.752 | Comparative example |

TABLE 8-continued

| Symbol | Amount of added Bi (%) | Cooling rate (° C./sec) during 5 sec immediately after hot rolling | $B_8$ (T) | $W_{17/50}$ (W/kg) | Remarks |
|---|---|---|---|---|---|
| 7C | 0.050 | 25 | 1.890 | 0.740 | Comparative example |
| 7D | 0.000 | 60 | 1.892 | 0.724 | Comparative example |
| 7E | 0.020 | 60 | 1.920 | 0.651 | Example of the Invention |
| 7F | 0.050 | 60 | 1.925 | 0.625 | Example of the Invention |

Example 8

A silicon steel slab comprising 0.065 wt % carbon, 3.40 wt % silicon, 0.065 wt % manganese, 0.05 wt % copper, 0.025 wt % aluminum, 0.0075 wt % nitrogen, 0.030 wt % antimony, 0.020 wt % molybdenum, 0.015 wt % selenium, 0.010 wt % sulfur, 0 wt % or 0.020 wt % bismuth and the balance was heated by induction heating to 1,400° C. for 60 minutes, and then hot-rolled into a hot-rolled sheet having a thickness of 2.7 mm. The hot-rolled sheet was cooled at a cooling rate of 80° C./sec for five seconds immediately after the end of the final pass of hot rolling. Then, hot-rolled sheet annealing was applied to the hot-rolled sheet at 950° C. for a minute, and after pickling, primary cold rolling was conducted into a thickness of 1.8 mm. Subsequently, intermediate annealing was applied to the cold-rolled sheet at 950° C. for 100 seconds, and after pickling, the sheet was cold-rolled into a final thickness of 0.23 mm. Then, decarburization annealing was applied to the cold-rolled sheet with an average $P_{H2O}/P_{H2}$ of 0.40 for the heating step (within a temperature range of from 250 to 740° C.), and a $P_{H2O}/P_{H2}$ of 0.40 or 0.60 for the soaking step. Then, an annealing separator prepared by fifty weight parts $Al_2O_3$ relative to 50 weight parts MgO having an amount of hydration adjusted to 1.5 wt % was coated onto the surface of the decarburization-annealed sheet in an amount of coating of 10 g/m$^2$ per single side of steel sheet. Then, final finishing annealing was carried out at a maximum temperature of 1,200° C. for five hours. Subsequently, electrolytic polishing based on an NaCl bath was applied to the final finishing-annealed sheet, and a mirror-surface treatment was applied to the steel sheet surface. Then, tension was imparted to the steel sheet by vapor-depositing TiN onto the steel sheet surface. After applying an insulating coating mainly comprising magnesium phosphate containing colloidal silica, linear strain areas having an angle of 85° to the rolling direction were introduced at intervals of 5 mm relative to the rolling direction by means of a plasma flame to complete a product. Epstein test pieces corresponding to 500 g were cut from the resultant product to measure the magnetic flux density $B_8$ and the iron loss $W_{17/50}$ by the Epstein test method. The magnetic property of the product thus obtained is shown in Table 9. In the grain oriented electromagnetic steel sheet manufactured under conditions meeting the present invention, a product having a very excellent magnetic property was stably obtained.

The final product of this example of the invention contained up to 0.0022 wt % carbon, 3.38 wt % silicon, 0.049 wt % manganese, 0.0005 wt % sulfur, 0.0005 wt % selenium, 0.0006 wt % aluminum, 7 wtppm nitrogen and 0.0026 wt % bismuth. Further, the final product of this example of the invention had an average value θ of shift angle of 2.5°.

TABLE 9

| Symbol | Amount of added Bi (%) | $P_{H2O}/P_{H2}$ during soaking | $B_8$ (T) | $W_{17/50}$ (W/kg) | Remarks |
|---|---|---|---|---|---|
| 8A | 0 | 0.40 | 1.920 | 0.750 | Comparative example |
| 8B | 0.02 | 0.40 | 1.939 | 0.692 | Comparative example |
| 8C | 0 | 0.60 | 1.922 | 0.701 | Comparative example |
| 8D | 0.02 | 0.60 | 1.982 | 0.564 | Example of the Invention |

Example 9

A silicon steel slab comprising 0.065 wt % carbon, 3.30 wt % silicon, 0.070 wt % manganese, 0.010 wt % copper, 0.025 wt % aluminum, 0.0085 wt % nitrogen, 0.040 wt % antimony, 0.020 wt % molybdenum, 0.022 wt % selenium, 0 wt % or 0.030 wt % bismuth and the balance iron was heated by induction heating to 1,400° C. for 60 minutes, and then, hot-rolled into a hot-rolled sheet having a thickness of 2.6 mm. The hot-rolled sheet was cooled at a cooling rate of 70° C./sec for five seconds immediately after the end of the final pass of hot rolling. Subsequently, the hot-rolled sheet was pickled without applying hot-rolled sheet annealing, and subjected to primary cold rolling into a thickness of 1.7 mm. Then, intermediate annealing was conducted at 1,190° C. for one minute, and after pickling, subjected to secondary cold rolling into a cold-rolled sheet having a product thickness of 0.22 mm. Then, grooves having a width of 100 μm and a depth of 25 μm were formed at an angle of 90° to the rolling direction at intervals of 3.0 mm relative to the rolling direction on the cold-rolled sheet by resist eteching, and then, decarburization annealing was conducted at 820° C. for 120 seconds. Decarburization annealing was carried out with an average $P_{H2O}/P_{H2}$ of 0.40 for the heating step (sheet temperature within a range of from 250 to 740° C.) and a $P_{H2O}/P_{H2}$ of 0.40 or 0.60 for the soaking step. An annealing separator mainly comprising MgO was coated onto the decarburization-annealed sheet, and then, final finishing annealing was conducted at a maximum temperature of 1,200° C. for five hours. Subsequently, an insulating coating mainly comprising magnesium phosphate containing colloidal silica was applied onto the final finishing-annealed sheet to complete a product. Epstein test pieces corresponding to 500 g were cut from the resultant product to measure the magnetic flux density Ba and the iron loss $W_{17/50}$ by the Epstein test method.

The magnetic property of the product thus obtained is shown in Table 10. In the grain oriented electromagnetic steel sheet manufactured under conditions meeting the present invention, a product having a very excellent magnetic property was stably obtained.

The final product of this example of the invention contained 0.0007 wt % carbon, 3.26 wt % silicon, 0.055 wt % manganese, 0.0001 wt % sulfur, 0.0014 wt % selenium, 0.0007 wt % aluminum, 8 wtppm nitrogen, and 0.0143 wt % bismuth in the substrate thereof. Further, the final product had an average value θ of shift angle of 1.8°.

TABLE 10

| Symbol | Amount of added Bi (wt %) | $P_{H2O}/P_{H2}$ during decarburization soaking | $B_8$ (T) | $W_{17/50}$ (W/kg) | Remarks |
|---|---|---|---|---|---|
| 9A | 0 | 0.40 | 1.881 | 0.805 | Comparative example |
| 9B | 0 | 0.40 | 1.877 | 0.846 | Comparative example |
| 9C | 0.030 | 0.40 | 1.896 | 0.787 | Comparative example |
| 9D | 0.030 | 0.60 | 1.924 | 0.635 | Example of the Invention |

Example 10

A silicon steel slab comprising 0.065 wt % carbon, 3.30 wt % silicon, 0.070 wt % manganese, 0.10 wt % copper, 0.025 wt % aluminum, 0.0085 wt % nitrogen, 0.040 wt % antimony, 0.020 wt % molybdenum, 0.022 wt % selenium, 0 wt % or 0.030 wt % bismuth, and the balance iron was heated by induction heating to 1,400° C. for 60 minutes, and then hot-rolled into a hot-rolled sheet having a thickness of 2.2 mm. The hot-rolled sheet was cooled at a cooling rate of 70° /sec for five seconds immediately after the end of the final pass of hot rolling. Subsequently, the hot-rolled sheet was subjected to hot-rolled sheet annealing at 1,000° C. for one minute, and after pickling, to cold rolling into a cold-rolled sheet having a product thickness of 0.35 mm. Then, decarburization annealing was carried out at 8500° C. for 100 seconds, with an average $P_{H2O}/P_{H2}$ of 0.45 for the heating step (region with a sheet temperature within a range of from 255 to 765° C.), and a $P_{H2O}/P_{H2}$ of 0.40 or 0.60 for the soaking step. Subsequently, an annealing separator mainly comprising MgO was coated onto the decarburization-annealed sheet. Then, finishing annealing was carried out at a maximum temperature of 1,2000° C. for five hours, and then, an insulating coating mainly comprising magnesium phosphate containing colloidal silica was applied to complete the product. Epstein test pieces corresponding to 500 g were cut from the thus obtained product to measure the magnetic flux density $B_8$ and the iron loss $W_{17/50}$ by the Epstein test method. The magnetic property of the resultant product is shown in Table 11. In the grain oriented electromagnetic steel sheet manufactured under conditions meeting the present invention, there is stably created a product having a very excellent magnetic property.

The final product of this example of the invention contained up to 0.0009 wt % carbon, 3.23 wt % silicon, 0.060 wt % manganese, 0.0001 wt % sulfur, 0.0009 wt % selenium, 0.0005 wt % aluminum, 4 wtppm nitrogen, and 3.25 wt % bismuth. Further, the final product of this example had an average value θ of shift angle of 1.60.

TABLE 11

| Symbol | Amount of added Bi (wt %) | $P_{H2O}/P_{H2}$ during decarburization soaking | $B_8$ (T) | $W_{17/50}$ (W/kg) | Remarks |
|---|---|---|---|---|---|
| 10A | 0 | 0.40 | 1.935 | 1.130 | Comparative example |
| 10B | 0 | 0.60 | 1.941 | 1.142 | Comparative example |
| 10C | 0.030 | 0.40 | 1.952 | 1.086 | Comparative example |

TABLE 11-continued

| Symbol | Amount of added Bi (wt %) | $P_{H2O}/P_{H2}$ during decarburization soaking | $B_8$ (T) | $W_{17/50}$ (W/kg) | Remarks |
|---|---|---|---|---|---|
| 10D | 0.030 | 0.60 | 1.989 | 0.966 | Example of the Invention |

Example 11

A silicon steel slab comprising 0.065 wt % carbon, 3.30 wt % silicon, 0.065 wt % manganese, 0.023 wt % aluminum, 0.0080 wt % nitrogen, 0.040 wt % antimony, 0.015 wt % molybdenum, 0.018 wt % selenium, 0 or 0.020 wt % bismuth, and the balance substantially iron was heated by induction heating to 1,400° C. for 60 minutes, and then, hot-rolled into a hot-rolled sheet having a thickness of 2.5 mm. The hot-rolled sheet was cooled at an average cooling rate of 50° C./sec for five seconds immediately after the end of the final pass of hot rolling. Subsequently, hot-rolled sheet annealing was applied to the hot-rolled sheet at 950° C. for one minute, and after pickling, primary cold rolling was carried out to a thickness of 1.6 mm. Then, intermediate annealing was applied at 1,000° C. for one minute, and after pickling, secondary cold rolling was conducted into a cold-rolled sheet having a final thickness of 0.23 mm. Then, decarburization annealing was performed under conditions including a soaking temperature of 850° C., a soaking period of 100 seconds, a $P_{H2O}/P_{H2}$ of 0.40, 0.60 or 0.75, and a $P_{H2O}/P_{H2}$ of 0.05, 0.10 or 0.20 for the atmosphere of the latter portion of decarburization annealing (50 seconds), or the same conditions as for the soaking step, with a $P_{H2O}/P_{H2}$ for the heating step equal to or lower by 0.10 than that for the soaking step. Subsequently, an annealing separator mainly comprising MgO was coated onto the decarburization-annealed sheet, and then, final finishing annealing was applied at a maximum reachable temperature of 1,200° C. for five hours. An insulating coating mainly comprising magnesium phosphate containing colloidal silica was applied to the finishing-annealed sheet, and linear strain areas having an angle of 90°γ to the rolling direction were introduced at intervals of 5 mm relative to the rolling direction by means of a plasma flame. An Epstein test piece corresponding to 500 g was cut from the resultant product to measure the magnetic flux density $B_8$ and the iron loss $W_{17/50}$ by the Epstein test method. The magnetic property of the product is shown in Table 11. In the grain oriented electromagnetic steel sheet manufactured under conditions meeting the present invention, a product having a very high magnetic flux density $B_8$ was obtained, and an excellent magnetic property was obtained particularly in 11I, 11J, 11K, and 11L.

The final product of this example of the invention contained 0.0005 wt % carbon, 3.25 wt % silicon, 0.045 wt % manganese, 0.0001 wt % sulfur, 0.0009 wt % selenium, 00004 wt % aluminum, 3 wtppm nitrogen, and 0.00816 wt % bismuth. Further, the final product of this example had an average shift angle value θ within a range of from 1.2 to 3.4°.

TABLE 12

| Symbol | Amount of added Bi (wt %) | $P_{H2O}/P_{H2}$ during decarburization annealing: During heating | During soaking | During latter portion | $B_8$ (T) | $W_{17/50}$ (W/kg) | Remarks |
|---|---|---|---|---|---|---|---|
| 11A | 0 | 0.40 | 0.40 | 0.40 | 1.925 | 0.811 | Comparative example |
| 11B | 0 | 0.40 | 0.40 | 0.05 | 1.942 | 0.771 | Comparative example |
| 11C | 0 | 0.50 | 0.60 | 0.60 | 1.922 | 0.823 | Comparative example |
| 11D | 0 | 0.40 | 0.40 | 0.05 | 1.946 | 0.762 | Comparative example |
| 11E | 0.02 | 0.40 | 0.40 | 0.40 | 1.934 | 0.751 | Comparative example |
| 11F | 0.02 | 0.40 | 0.40 | 0.05 | 1.942 | 0.758 | Comparative example |
| 11G | 0.02 | 0.60 | 0.60 | 0.60 | 1.968 | 0.669 | Example of the Invention |
| 11H | 0.02 | 0.50 | 0.60 | 0.60 | 1.981 | 0.642 | Example of the Invention |
| 11I | 0.02 | 0.60 | 0.60 | 0.05 | 1.982 | 0.643 | Example of the Invention |
| 11J | 0.02 | 0.50 | 0.60 | 0.05 | 1.990 | 0.602 | Example of the Invention |
| 11K | 0.02 | 0.60 | 0.60 | 0.10 | 1.980 | 0.631 | Example of the Invention |
| 11L | 0.02 | 0.50 | 0.60 | 0.10 | 1.989 | 0.595 | Example of the Invention |
| 11M | 0.02 | 0.60 | 0.60 | 0.20 | 1.969 | 0.672 | Example of the Invention |
| 11N | 0.02 | 0.75 | 0.75 | 0.75 | 1.939 | 0.752 | Comparative example |
| 11O | 0.02 | 0.75 | 0.75 | 0.05 | 1.947 | 0.721 | Comparative example |
| 11P | 0.02 | 0.65 | 0.75 | 0.05 | 1.950 | 0.716 | Comparative example |
| 10Q | 0.02 | 0.75 | 0.75 | 0.10 | 1.942 | 0.746 | Comparative example |

According to the present invention, it was possible to stably manufacture a grain oriented electromagnetic steel sheet having excellent magnetic properties.

What is claimed is:

1. A method of making a grain oriented electromagnetic steel sheet from a silicon steel slab containing from about 0.03 to 0.10 wt % carbon, from about 2.0 to 5.0 wt % silicon, from about 0.04 to 0.15 wt % manganese, from about 0.01 to 0.03 wt % of either or both of sulfur and selenium, from about 0.015 to 0.035 wt % soluble aluminum and from about 0.0050 to 0.010 wt % nitrogen and wherein said slab contains from about 0.001 to 0.07 wt % bismuth comprising:

heating said slab to a temperature of at least about 1,300° C., hot-rolling the heated steel slab, then achieving a final sheet thickness through a combination of annealing and cold rolling, decarburization-annealing the sheet of the final thickness, and conducting final finishing annealing to the decarburization-annealed sheet;

controlling the average cooling rate to about 30 to about 1200° C./sec for a period of five seconds measured from immediately after the end of hot rolling; and soaking during at least a portion of the decarburization annealing while establishing a $P_{H2O}/P_{H2}$ ratio in the atmosphere to about 0.45 to about 0.70.

2. A method according to claim 1, wherein the surface of the finally finishing-annealed steel sheet has an oxygen content of up to about 1.5 g/m$^2$ per single side.

3. A method according to either of claims 1 or 2, further comprising inhibiting decomposition of the surface layer inhibitor during finishing annealing by an annealing separator treatment comprising the steps of controlling the amount of added $TiO_2$ to about 10 weight parts or less, relative to about 100 weight parts of MgO, and controlling the amount of hydration of MgO and the amount of coated annealing separator so as to satisfy the following formula (1):

$$Y \leqq 3X+15 \quad (1)$$

where X represents the amount of hydration of the total MgO (wt %), and where Y represents the total amount of coated annealing separator (wt %) present per single face of said steel sheet after coating and drying.

4. A method according to either of claims 1 or 2, wherein said steel slab contains one or more elements selected from the group consisting of from about 0.01 to 0.5% tin, from about 0.05 to 0.5% nickel, from about 0.05 to 0.5% chromium and from about 0.001 to 0.1% germanium.

5. A method according to claim 1, wherein the soaking temperature in the decarburization annealing step is within a range of from about 800 to about 900° C.

6. A method according to claim 5, wherein inhibiting decomposition of the surface layer inhibitor during final finishing annealing comprises the step of maintaining a value of the ratio $P_{H2O}/P_{H2}$ that exists at the atmosphere at the heating step of said decarburization annealing at a value lower than the value of $P_{H2O}/P_{H2}$ in the atmosphere that exists at said soaking step of said decarburization annealing.

7. A method according to claim 6, wherein the value of the ratio $P_{H2O}/P_{H2}$ in the atmosphere in the heating step of decarburization annealing is kept substantially within a range satisfying the following formula (2) relative to the value of the ratio $P_{H2O}/P_{H2}$ in the atmosphere in the soaking step of decarburization annealing:

$$X2-0.25 \leqq X1 \leqq X2-0.05 \quad (2),$$

where X1 represents the ratio $P_{H2O}/P_{H2}$ in the atmosphere in the heating step, and where X2 represents the ratio $P_{H2O}/P_{H2}$ in the atmosphere in the soaking step.

8. A method according to any one of claims 5 to 7, wherein said soaking portion of said decarburization annealing step is divided into former and latter portions, wherein said temperature in said latter portion is kept at a temperature within a range of from about 820 to about 920° C.; and wherein the ratio $P_{H2O}/P_{H2}$ in the atmosphere of said latter portion of said soaking step is controlled at about 0.15 or less; and wherein said dwell period in said latter portion is kept within a range of from about 5 to about 200 seconds.

* * * * *

UNITED STATES PATENT AND TRADEMARK OFFICE

CERTIFICATE OF CORRECTION

PATENT NO. : 6,280,534 B1
DATED : August 28, 2001
INVENTOR(S) : Senda et al.

It is certified that error appears in the above-identified patent and that said Letters Patent is hereby corrected as shown below:

Column 7,
Line 44, please change "1,2000°C" to -- 1,200°C --.

Column 18,
Line 26, please change "900" to -- 90° --.

Column 30,
Line 54, please change "Ba" to -- $B_8$ --.

Column 31,
Line 32, please change "8500°C" to -- 850°C --; and
Line 55, please change "1.60" to -- 1.6° --.

Signed and Sealed this

Twelfth Day of March, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,280,534 B1
DATED : August 28, 2001
INVENTOR(S) : Senda et al.

It is certified that error appears in the above-identified patent and that said Letters Patent is hereby corrected as shown below:

Column 33,
Line 58, please change "1200ºC./sec" to -- 120ºC./sec --.

Signed and Sealed this

Tenth Day of August, 2004

JON W. DUDAS
*Acting Director of the United States Patent and Trademark Office*